United States Patent [19]

McKinney et al.

[11] Patent Number: 4,823,914

[45] Date of Patent: Apr. 25, 1989

[54] STATUS LINE MONITORING SYSTEM AND METHOD OF USING SAME

[75] Inventors: Robert C. McKinney, Lakeside; Lloyd F. Perry, San Diego; Scott T. Boden, El Cajon, all of Calif.

[73] Assignee: Elevator Performance Technologies, Inc., Santee, Calif.

[21] Appl. No.: 66,014

[22] Filed: Jun. 24, 1987

[51] Int. Cl.[4] ..... B66B 3/00

[52] U.S. Cl. ..... 187/133

[58] Field of Search ..... 187/130, 133

[56] References Cited

U.S. PATENT DOCUMENTS

| | | | |
|---|---|---|---|
| 3,973,648 | 8/1976 | Hummert et al. | 187/133 |
| 4,512,442 | 4/1985 | Moore et al. | 187/133 |
| 4,568,909 | 2/1986 | Whynacht | 187/133 |
| 4,698,780 | 10/1987 | Mandel et al. | 187/130 |

*Primary Examiner*—William M. Shoop, Jr.
*Assistant Examiner*—W. E. Duncanson, Jr.
*Attorney, Agent, or Firm*—Bernard L. Kleinke

[57] ABSTRACT

A monitor system for use with a plurality of segregated groups of controls, each group having corresponding status control lines indicative of the operational status of an elevator, an escalator, or the like. The monitor system includes a series of monitor devices for responding to the status control lines. Each one of the monitor devices corresponds to an individual one of the group of controls, for diagnosing the operational problems associated therewith. A computing device is located remotely from the groups of controls, for monitoring them remotely and continuously. A plurality of individual single communication links correspond individually to one of the monitor devices, for facilitating connection selectively and individually of the monitor devices to the remote computing device.

16 Claims, 22 Drawing Sheets

SERVICE COMPANY
PRINTER
COMPUTER
DISC
COMMUNICATION SYSTEM
PRINTER
COMPUTER
DISC
PRINTER
MASTER MODULE
SLAVE MODULE
SLAVE MODULE
MONITOR
PRINTER
MONITOR
ELEVATOR SHAFT CONTROLS
ELEVATOR SHAFT CONTROLS
ELEVATOR SHAFT CONTROLS
ELEVATOR SHAFT CONTROLS
ELEVATOR SHAFT CONTROLS
BUILDING A
BUILDING B
10
11
12
13
14
16
18
20
22
24
26
28
30
33
35
36
37
39
40
41
42
43
45
47
48
49
58
60
L

102
MASTER OSC.
XTI 4MHZ
C2 .001UF
R2 1.3K
R3 1.3K
U2 74LS04
C1 .001UF
U16 74LS04
4MHZA
74LS04
4MHZB
U1 6809E
+5 PIN 7 GND PIN 1
100
CPU
50
U7 74LS244
74LS244 U6
52
CONTROL
-FIRQ
-IRQ
-RESET
VCC
U10 4050
(/Q*E)
U11 74LS02
WAIT STATE GENERATOR
U12 74LS107
104
-MEM000
4MHZB
VCC
U5 74LS245
U8 74LS32
-IE
/Q
4MHZA
106
U3 74LS107
CPU TIMING GENERATOR
U4 74LS244
AVMA
E
-RAMW
-/Q

PROBE BUS ADDRESS AND CONTROL
J2
IDO50
PROBE I/O CONNECTOR
PR/W
PQ
PE
PROBES7
PROBES6
PROBES5
PROBES4
PROBES3
PROBES2
PROBES1
PROBES0
PA4
PA3
PA2
PA1
PA0
PD7
PD6
PD5
PD4
PD3
PD2
PD1
PD0
U33
74LS244
132
U32
74LS245
134
PROBE BUS DATA
R/W
U8
74LS32
-IOSENSORS
-EQ

STATUS LINE MONITORING SYSTEM AND METHOD OF USING SAME

DESCRIPTION

1. Technical Field

The present invention relates in general to monitoring systems, and it relates more particularly to a system for monitoring and diagnosing remotely the operation and status of a plurality of groups of elevators, escalators or the like.

2. Background Art

Conventional elevator control systems have included monitoring devices for providing limited information for maintenance and other purposes. The conventional monitoring devices generally include limited basic monitoring features, such as indicating the location of an elevator car. However, the monitoring requirements of large multi-car elevator systems for modern buildings frequently are complex. Thus, for many modern applications, efficient maintenance services would be facilitated by a more comprehensive monitoring system.

It would be highly desirable to have an elevator monitor system which could be connected electrically in an easy and convenient manner to existing elevator system controls, without modification thereto. The monitoring system should be responsive to complex functions of modern elevators, and yet be installed on existing elevators.

Therefore, it would also be highly desirable to have a monitoring system, which diagnoses groups of elevators located in different builings. In this manner, an elevator service company, servicing a number of different buildings, could utilize such a monitoring system, to provide more efficient and effective maintenance service. The monitor system should be relatively inexpensive to manufacture, so that it can be cost effective and affordable for the building to use. It should be operable conveniently and simply without the need for highly trained personnel. The monitor system, by its use, could further reduce the safety hazards associated with the use of the elevator systems being monitored.

DISCLOSURE OF INVENTION

Therefore, the principal object of the present invention is to provide a new and improved system and method for monitoring groups of controls, such as elevator controls, or the like, located in one or more geographically separated buildings, in a relatively inexpensive, convenient, and expeditious manner.

A further object of the present invention is to provide such a new and improved system and method, which are adapted to be connected to existing controls, in a convenient manner without modifying them, to facilitate maintenance thereof.

Briefly, the above and further objects of the present invention are realized by providing a new and improved monitoring system for use with a plurality of groups of controls, such as elevator controls. Each group has corresponding status control lines indicative of the operational status of an elevator, or other device being monitored. The monitoring system includes a series of monitor devices for responding to the status control lines.

Each one of the monitor devices corresponds to an individual one of the group of controls, for diagnosing the operational problems associated therewith. A computing device is located remotely from the groups of controls, for monitoring them remotely and continuously. A plurality of individual single communication links correspond individually to one of the monitor devices, for facilitating connection selectively and individually of the monitor devices to the remote computing device.

Thus, the inventive elevator monitor system is adapted easily and convenienty to existing elevator, without undue modification to the circuitry. Moreover, the system may also be for other systems, such as controls for escalators. In this regard, the monitor system permits data storage and diagnosis to be accomplished from a remote station, without the requirement of extensive or expensive electrical cabling.

The inventive monitor system is capable of diagnosing remotely and collectively a group of physically separated elevator or escalator systems at an affordable price, regardless of the number of elevators, or escalators being monitored. The monitor system is operable conveniently and simply by an non-experienced user, as well as by a handicapped person. The availability of such monitoring system, reduces the safety hazards associated with the use of the elevator and escalator system being monitored.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
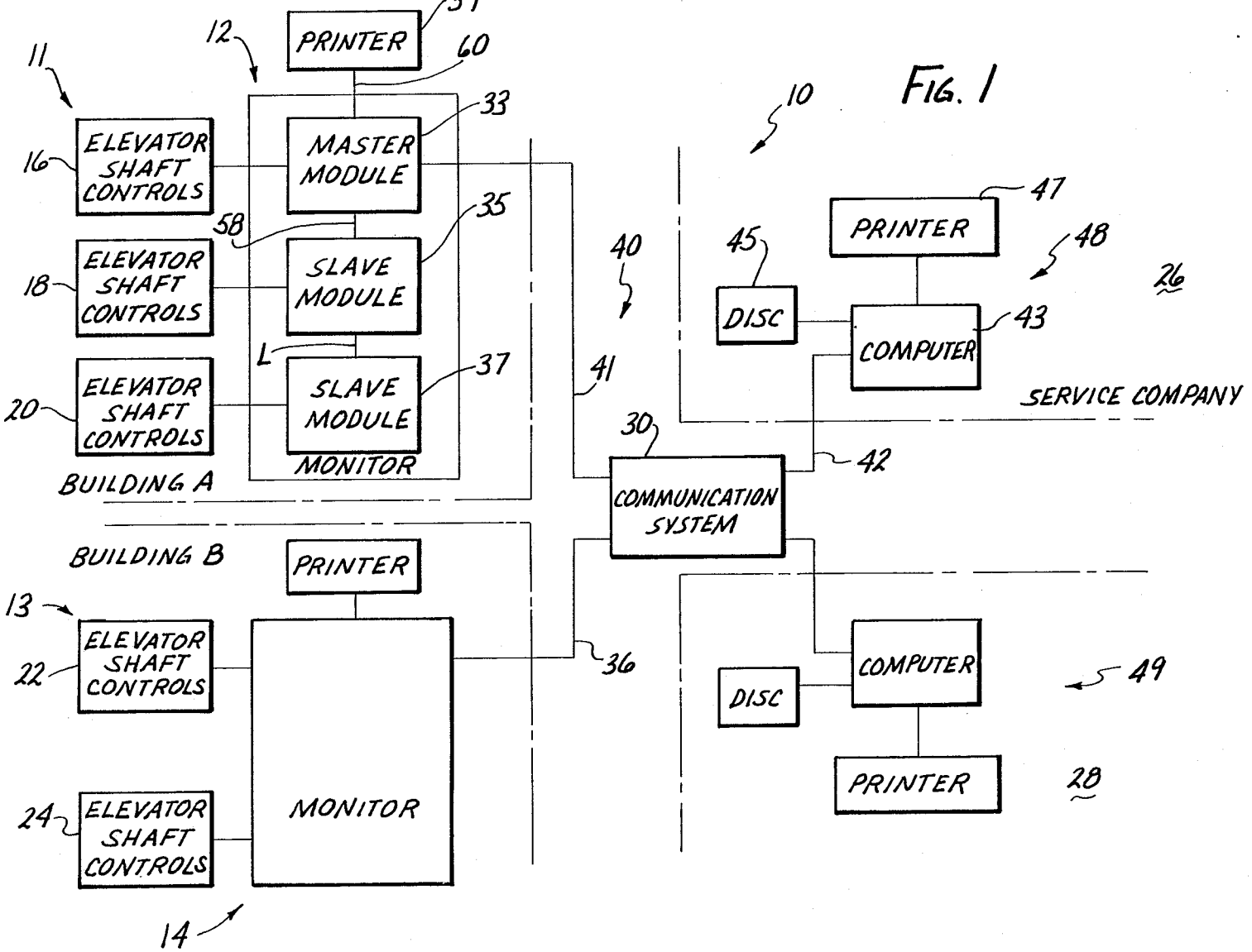
FIG. 1 is a block diagram of a monitoring system, which is constructed in accordance with the present invention, and which is shown connected in use with two groups of elevator shaft controls located in a plurality of different buildings.

Referring now to the drawings and more particularly to FIG. 1 thereof, there is illustrated a monitor system 10, which is constructed according to the present invention, and which is adapted to be connected electrically to a pair of groups of elevator shaft controls 11 and 13 located physically in two different buildings A and B, containing groups of elevator shafts (not shown). For illustration purposes only, the building A is equipped with three elevator shafts, and the building B includes two elevator shafts. However, it will be apparent to those skilled in the art that there may be many more than that number of shaft controls being monitored.

A plurality of remotely located computing devices 48 and 49, are each located in different buildings for receiving report messages regarding fault and other conditions of the elevator shaft controls. Thus, one of the computing devices may be located in a service company, a building manager's home, and/or other remote locations.

While the system 10 may be used, as shown and described herein, it may also be used for monitoring conditions of escalators, or other such apparatus.

The system 10 generally includes a series of monitor devices, such as the monitor devices 12 and 14, for interfacing with a plurality of different groups of elevator shaft control groups 11 and 13. The group 11 comprises a set of three controls 16, 18, and 20. The group 13 comprises the controls 22 and 24. Each one of these segregated groups of controls has corresponding status control lines (not shown) indicative of the operational status of a corresponding elevator.

The monitor devices, such as the monitor devices 12 and 14 are generally similar in construction and design, and therefore only the monitor device 12 will be described hereinafter in greater detail. The device 12 is located in the separate building A, and is connected to the elevator shaft controls 16, 18 and 20, for monitoring and diagnosing operational problems associated therewith.

The monitor device 12 generally includes one master module 33, and may include one or more similar slave modules, such as the slave modules 35 and 37. Each one of the modules is connected to an individual one of the control groups 16, 18 and 20, each one of which being associated with corresponding ones of the elevator shafts in the building A. A printer 39 is connected to the master module 33 for generating written status reports.

The plurality of computer devices 48 and 49 are located at remote stations, such as the remote stations 26 and 28 at different buildings. The computer devices 48 and 49 are generally similar, and therefore only the computing device 48 will be described hereinafter in greater detail.

The computing device 48 is located at the service company building, so that service personnel can receive and review elevator shaft control reports containing status information concerning individual shaft controls. The device 48 generally includes a computer 43, which may be a conventional personal computer such as the one manufactured by Kaypro under models No. PC30 or EXP. A computer software program shown in FIGS. 7 through 19, is stored on a memory element, such as a floppy disk (not shown), and is initially installed onto a hard disk 45 of the computer 43, to control its operation. As will become apparent to those skilled in the art, there can be other techniques used to install the programs in the memories of the remotely located computing devices. However, the important advantage of the disclosed form of the present invention is that low cost, widely-available personal computers may be employed at the remote locations. In this manner, copies of the program may be distributed by any convenient technique to any number of remote locations, and installed on personal computers for receiving reports at the remote locations, as will be described in greater details.

A printer 47 is connected to the computer 43, for generating written status reports. The printer 47 is generally similar to the printer 39, and may be a conventional printer, such as the one manufactured by Panasonic as model No. 1080I, or by Star as part number NP-10.

A plurality of individual single communication links, such as the communication links 36 and 41, correspond individually to one of the respective monitor devices 14 and 12, for facilitating connection selectively and individually between each one of the monitor devices and the remotely located computing devices 48 and 49, via a communication system 30, such as a telephone switching system. In this regard, the master module 33 includes a modem 67 (FIG. 2) for establishing and receiving calls to and from either one of the computing devices, which are each equipped with a modem (not shown).

In operation, if any one of the monitor devices, such as the device 12, detects the presence of certain fault conditions over the status lines of the elevator shaft control groups, such as the group of controls 20, a corresponding slave module 37 of the monitor device 12, compiles the monitored information, determines that a fault has occurred, and formulates the message information for generating a report message. Such message is then relayed sequentially from the slave module 37 to the next slave module 35, and from the module 35 finally to the master module 33. The master module 33 then communicates the fault message to the remote computing devices, such as the computing device 48. In this regard, a communication path is, for example, established from the modem 67, through the communication link 41, the communication system 30, a link 42 to the computer 43 for printing a report by the computer printer 47. A visual discernable image of the generated message may then be displayed on a monitor (not shown) of the computer 43, if desired.

Upon detecting the incoming message, an operator at the remote station 26 evaluates information contained in the incoming message, and decides on the appropriate corrective steps to be taken. For example, the operator can cause the device 12 to send paging signals to the maintenance personnel, to dispatch one or more technicians to the corresponding site. The operator can further identify specifically the fault and the source of the problem to such maintenance personnel. Thus, the time spent for the maintenance of the fault is minimized or at least reduced. Thus, personnel are provided with a fault indication, as well as certain basic information concerning the nature of the fault, to help in the necessary repairs.

As hereinafter described in greater detail, other modes of operation of the system 10 may also be performed. For example, periodic reports of all of the shaft controls of both groups 11 and 13 may be sent to either one or both of the remotely located computers, as well as the local printers, such as the printer 39. Various types of fault conditions can also be recognized, and identified in the reports.

Figure 2:
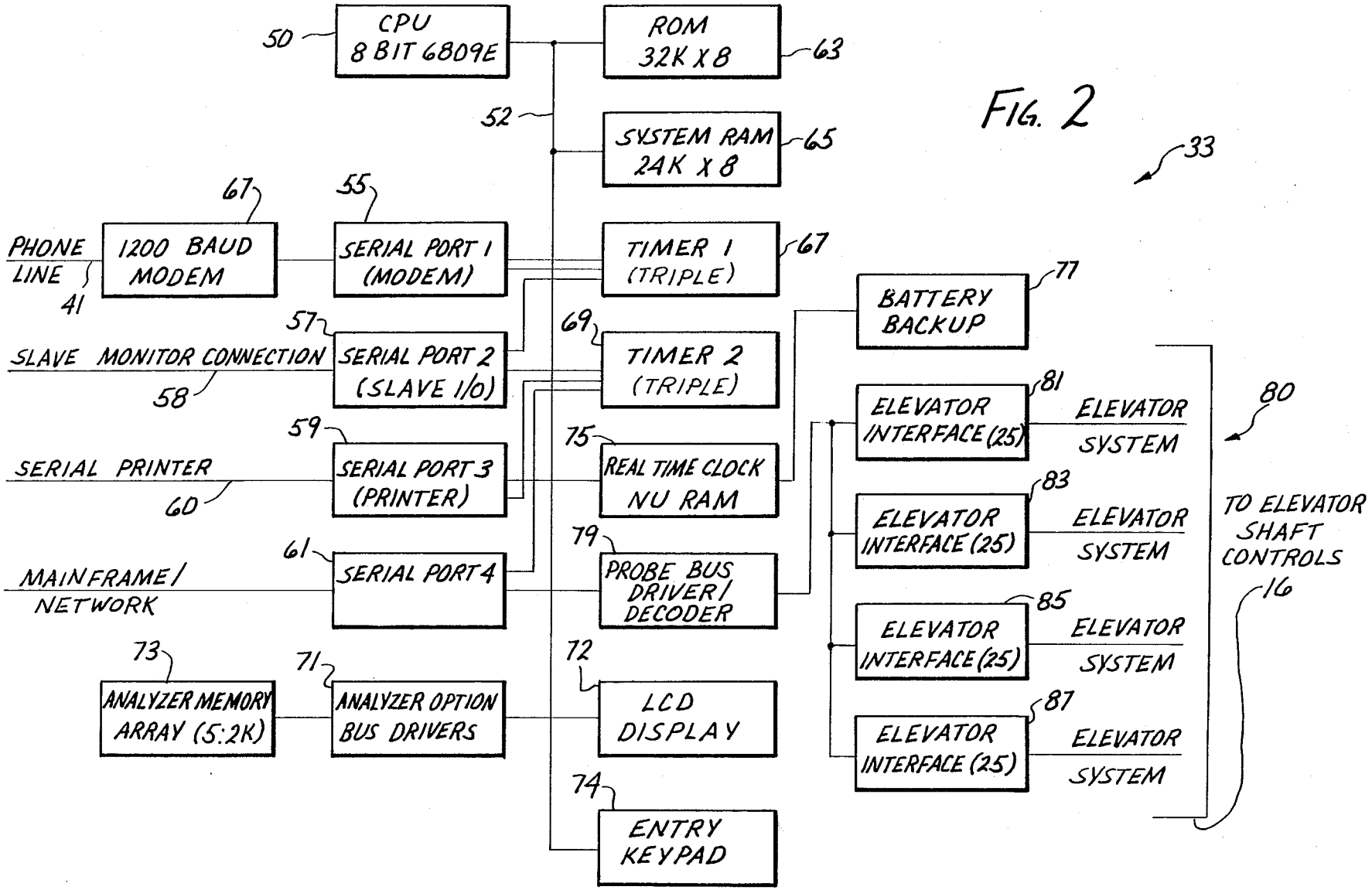
FIG. 2 is a block diagram of a master monitor module which forms a part of the system of FIG. 1.

Considering now the master module 33 in greater detail with respect to FIG. 2 of the drawings, it generally includes a central processing unit circuit generally indicated at 50, for enabling the execution of various system commands. A system bus 52 interconnects the master module components, such as the serial input/output ports 55, 57, 59 and 61 of the CPU circuit 50. A random-access memory 65 serves to store the messages generated by, or received by the master module 33, either from the serial ports, such as the serial port 57, or from the elevator shaft controls 16.

A read-only memory 63 serves to store the computer firmware for the master module 43. The firmware in the read only memory 63 controls basically two modes of operation of the master module 33. The first mode of operation is the interrupt mode, whereby the operation of the CPU circuit 50 is interrupted, and is instructed to read the status of all the status lines or probes, Probes 0–7 (FIG. 3) from the elevator shaft controls 16, to make copies thereof, and to store the copies in the random access memory 65.

The second mode of operation, which is controlled by the firmware, is the normal mode of operation, whereby the random access memory 65 checks for the presence of any serial data from the slave modules 35 and 37, or from the remote stations 26 or 28, via the communication link 41.

If no such serial data is detected, the master module 33 is instructed to check any change in the switch positions of the elevator shaft controls 16. Should no change in the switch positions take place, then the master module 33 is instructed to check for any fault condition. If a fault condition is detected, the master module 33 then determines whether there is any modem data.

Figure 5A:
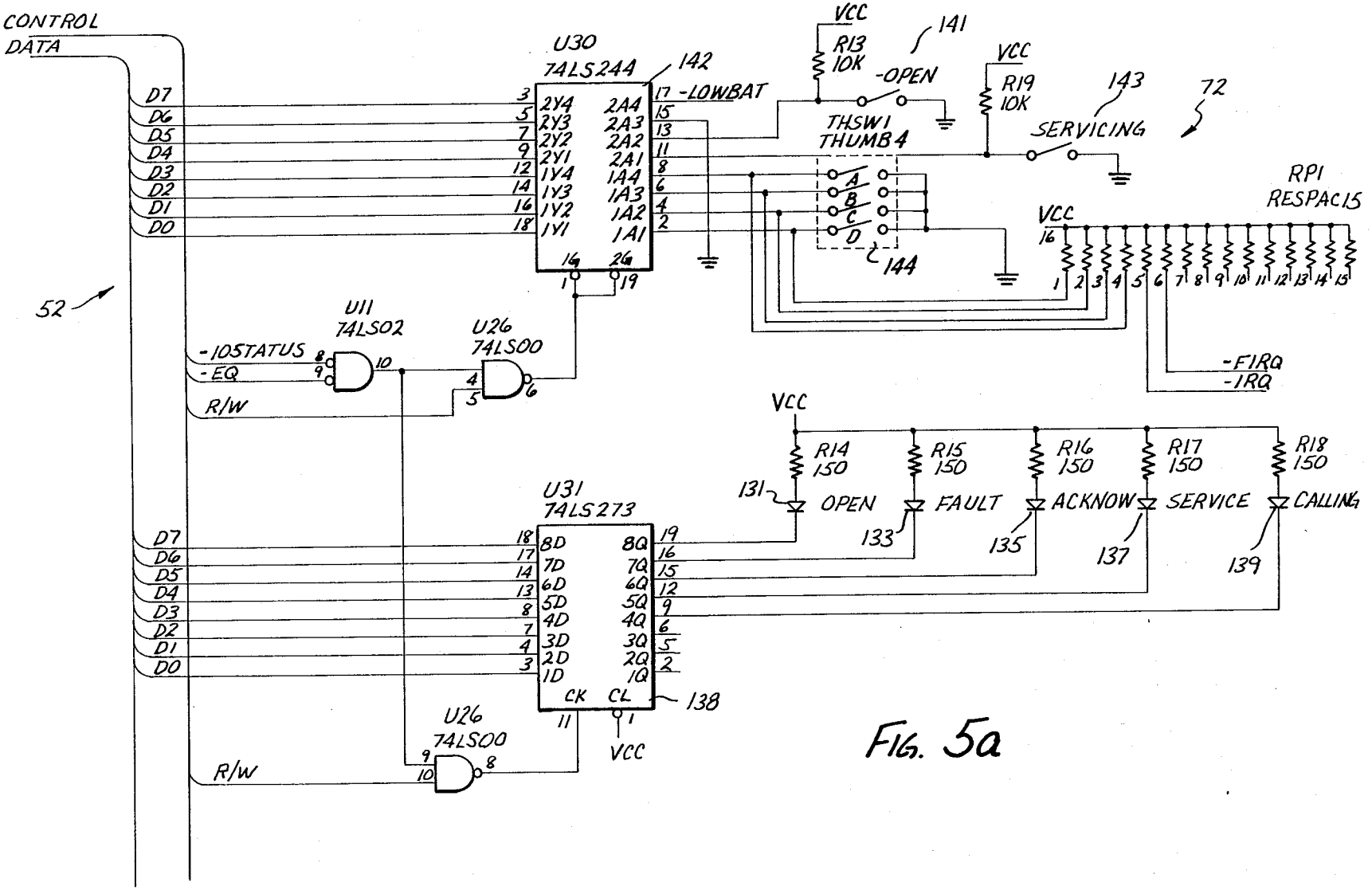
FIG. 5 is a circuit diagram of a light emitting display, which form a part of the master module of FIG. 2.
Figure 5B:
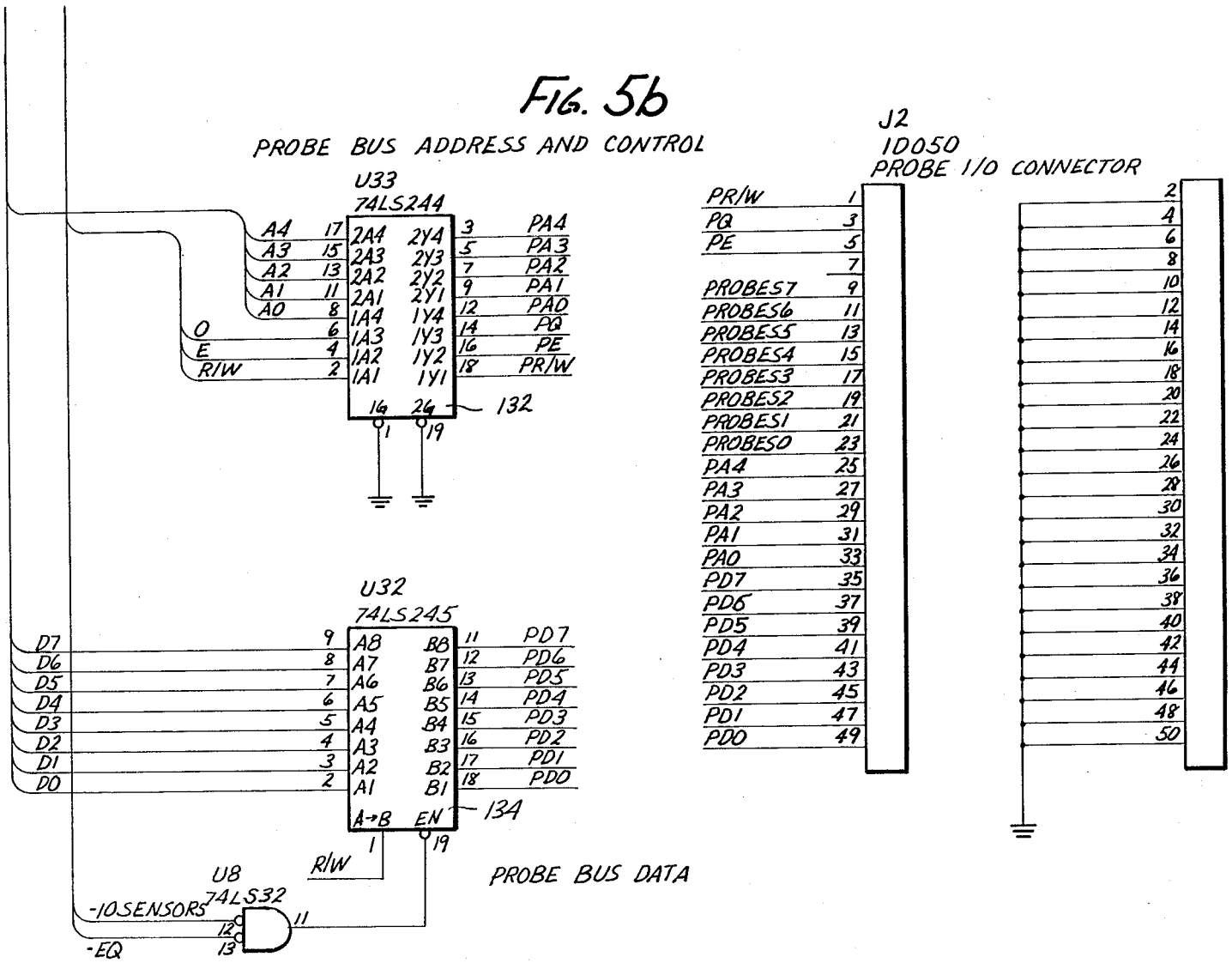

Should modem data be detected, then a modem data routine is executed. On the other hand, if serial data is detected from either of the slave modules 35 or 37, then a slave data routine is executed. If a fault condition is detected, then the modem 67 is activated, and the compiled message in the random access memory 65 is sent to a remote computing device 48 or 49, for acknowledgement. The operator at the receiving remote station 26 or 28 then acknowledges the receipt of such message, and the computing device sends a command to activate the light emitting diode 135 (FIG. 5).

When the module 33 receives the proper acknowledgement message, the CPU controller 50 then causes the received message to be stored in the random access memory 65. Thereafter, the modem 67 can be used to communicate messages to the remote stations, via the system bus 52, and the serial port 55. The transmitted message thereafter causes the modem 67 to address the message selectively to one of its remote stations, such as the remote station 26, via the communication system 30.

The modem 67 is a serial, conventional, serial two way communication device, for enabling the device 12 to communicate with either one of the remote computing devices 48 and 49. The modem 67 is connected between the telephone line communication link 41, and the serial port 55.

The serial port 57 is adapted to be connected to the preceding slave module 35 via a lead 58. A lead 60 interconnects the serial port 59 and the printer 39. The serial port 61 is adapted to be connected to a remotely located mainframe network computer (not shown), for general maintenance purposes.

A series of different timers, such as the timers 67 and 69, are connected to the system bus 52, and generate different speeds (baud rates) of clock signals, for use in the internal operation of the system. The timers 67 and 69 are also connected to the serial ports 55, 57, 59 and 61, to enable the operator to configure the various auxiliary equipment, connected to the master module 33, such as the modem 67, the printer 39, and other auxiliary equipment (not shown) connected to the mainframe network. The timer 67 is connected to the modem 67 and to the slave module 35 for configuring them to a particular predetermined speed (baud rate). Similarly, the timer 69 is connected to the serial port 61 and to the mainframe network for providing another predetermined generally different speed or (baud rate).

The master module 33 is also adapted to enable the operator at the remote stations 26 or 28 to configure the monitor device 12 remotely, by accessing the serial port 55 over the communication links 41 and 42, and the communication system 30, using the modem 67. In this regard, when the monitor device 12 is first installed in building A, and is connected to the elevator shaft controls 16, 18 and 20, the operator can cause a configuration routine to be run, either on site, or remotely.

A bus driver 71 and a memory array unit are connected to the system bus 52. Other auxiliary equipment, such as an LCD display 72, and an entry keypad 74 are also connected to the system bus 52, in order to monitor and to access the messages sent over the system bus 52.

A real time clock 75 includes memory (not shown) for storing a telephone number to be dialed by the modem 67, in order to access and to communicate with the computing devices 48 and 49. The real time clock 75 also includes the calender, and the configurations of the various auxiliary equipment. The foregoing information is stored in the real time clock 75, in order to safeguard such information in the event of a power failure. A back-up battery 77 is connected to the real time clock 75, and supplies it in the event of a power failure.

Figure 6:
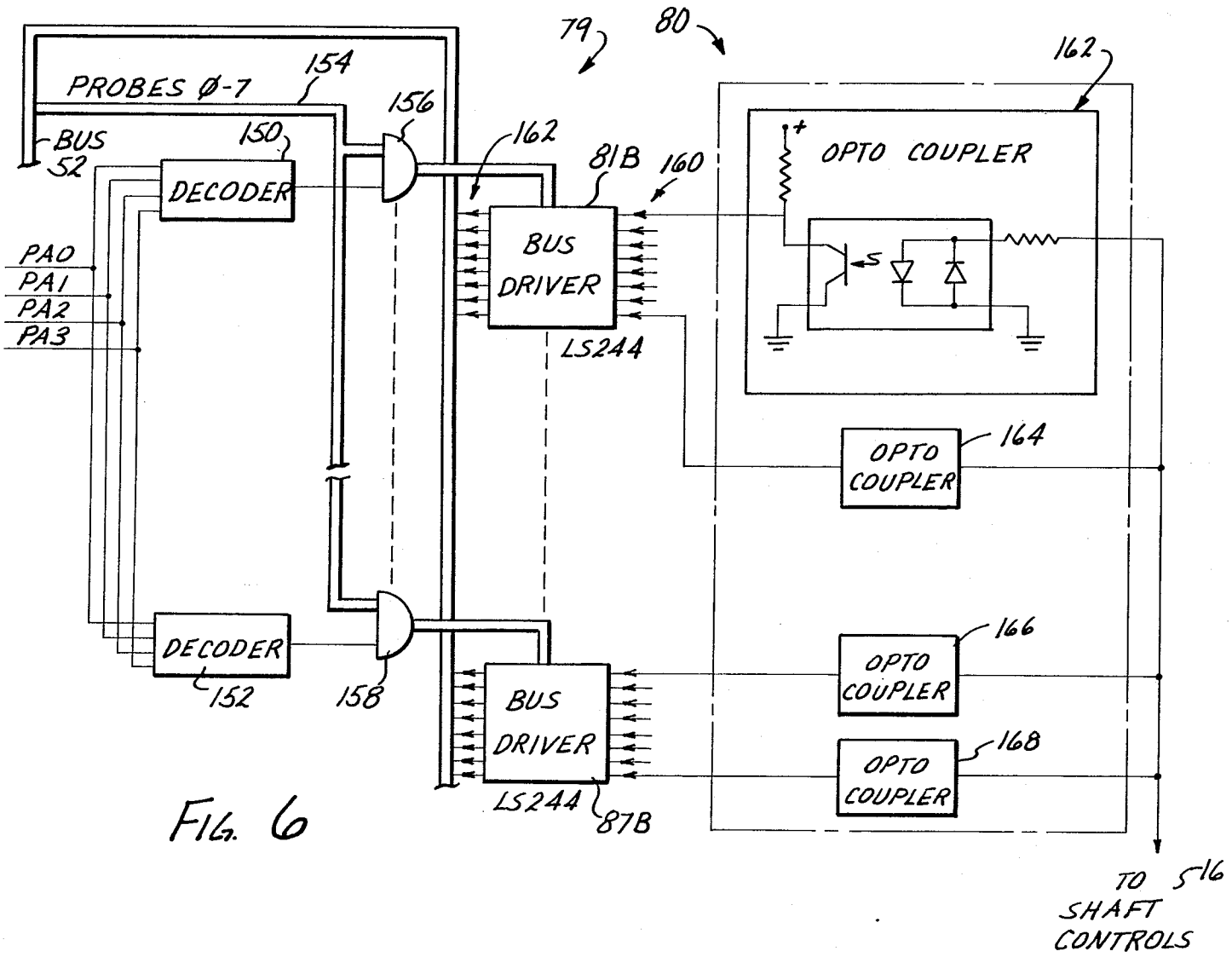
FIG. 6 is a functional block diagram of a probe bus driver/decoder unit, which forms a part of the master module of FIG. 2.

As indicated in FIGS. 2 and 6, a probe bus driver/decoder unit 79 is connected to the system bus 52, for monitoring selectively a plurality of elevator interface circuits collectively indicated at 80. In the preferred embodiment, the master module 33 includes four generally similar interface circuits 81, 83, 85 and 87, which are connected to 100 status lines of the elevator shaft control 16, in order to monitor the operational status of the corresponding elevator (not shown). Thus, as hereinafter described in greater detail, each elevator interface board, such as the circuit 81 generally monitors 25 status lines. Thus, if a fault condition is detected by any elevator interface board, such as the circuit 81, a coded signal is relayed to the CPU controller 50 for diagnosis. The coded signal is then compared with prestored data in the read only memory 63, indicative of preselected fault conditions in the device 12. If a fault condition is found to exist, the CPU controller 50 causes the fault information to be compiled and formulates a fault message and instructs the modem 67 to send such message to the remote stations 26 or 28.

Considering now the slave modules 35 and 37, they are generally identical, and therefore only the slave module 35 will now be described with respect to FIG. 2A. The letter "A" has been added to each reference character to designate the various slave module components which are similar to corresponding components of the master module.

Figure 2A:
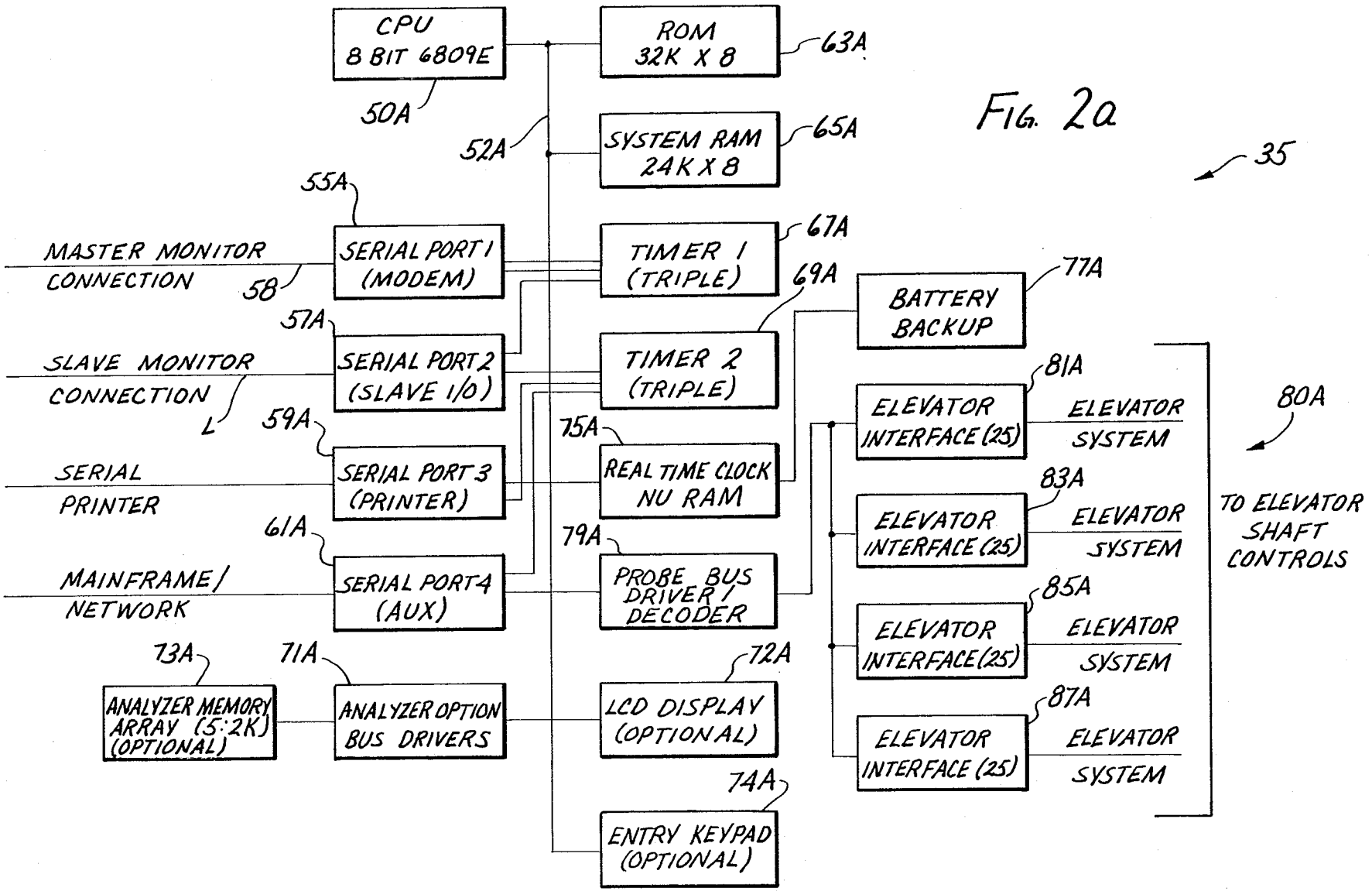
FIG. 2A is a block diagram of a slave module which forms a part of the system of FIG. 1.

The components of the slave module 35 as shown in FIG. 2A, are generally similar to the components of the master module, with the exception of the modem 67 (FIG. 2) of the master module 33 not being employed in the slave module. Instead, as shown in FIG. 2A, a serial port 55A is adapted to be connected to the serial port 57 of the master module 33 via the connection lead 58. A serial port 57A of the slave module 35 is adapted to be connected to a corresponding serial port (not shown) of the slave module 37 via a connection lead L. Thus, the generally similar configuration of the master module 33 and the slave module 35 and 37, enables the sequential interconnection of these modules, without the requirement for additional dedicated ports for each module. In this regard, a third slave module (not shown) could be added to the system 10 by interconnecting the additional module to the end module 37.

It follows that only two serial ports, such as the serial ports 55 and 57 of the master module 33, and the serial ports 55A and 57A of the slave module 35 are required to interconnect a set of modules, and to communicate the messages compiled and formulated in any of the modules 33, 35 or 37, to the remote stations 26 and 28. Therefore, according to the invention, only one communication link 41, such as telephone line, is required for the monitor device 12 to interface with the remotely located computing devices, and to communicate selectively with one or more of the remotely located stations, such as the stations 26 and 28. Furthermore, the sequential interconnection of the master module 33 and the slave modules 35 and 37, enables these modules to communicate between and amongst each other.

Figure 3A:
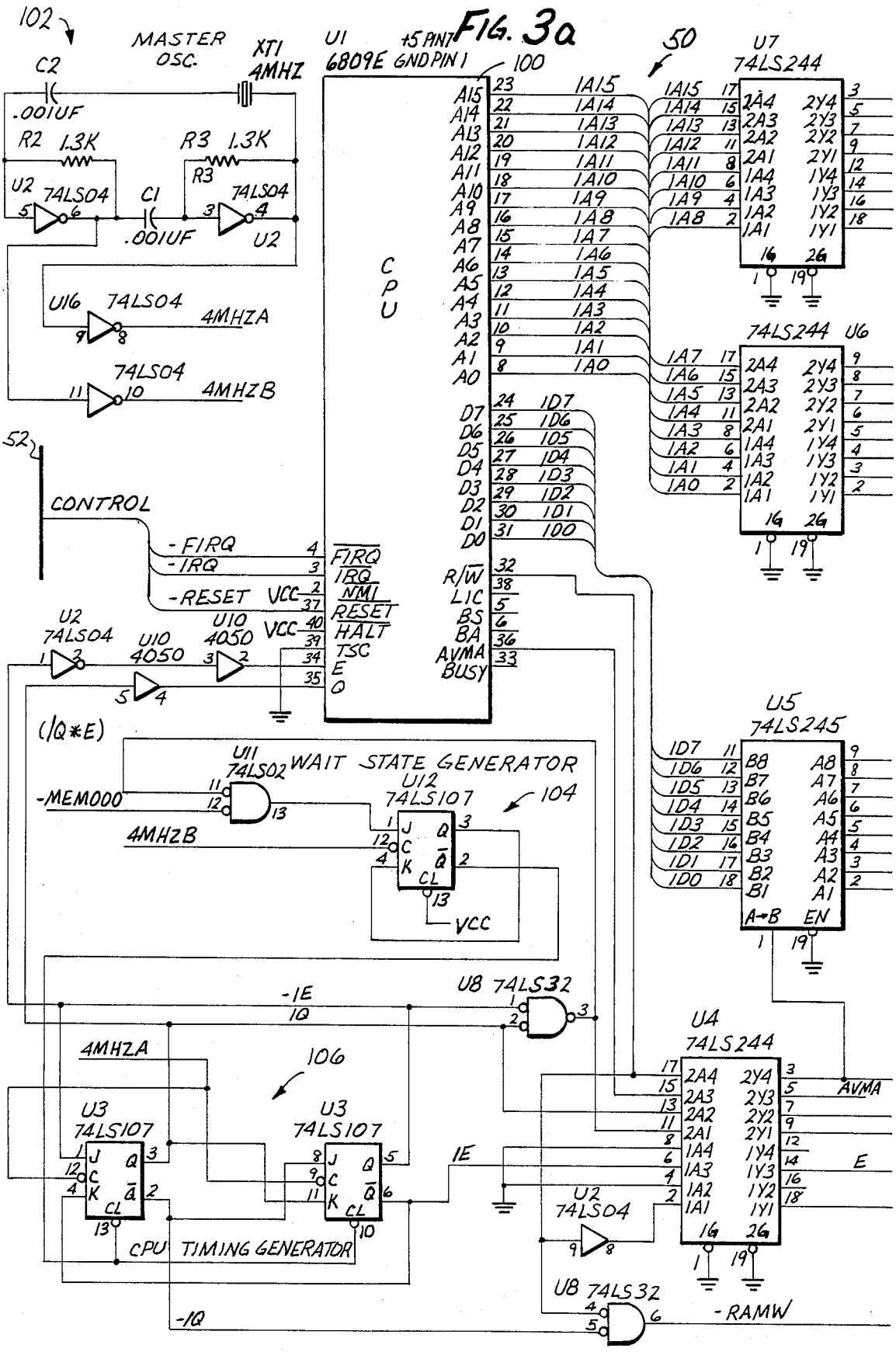
FIGS. 3A & B are a circuit diagram of a computer processor unit printed circuit board which forms a part of the master module of FIG. 2.
Figure 3B:
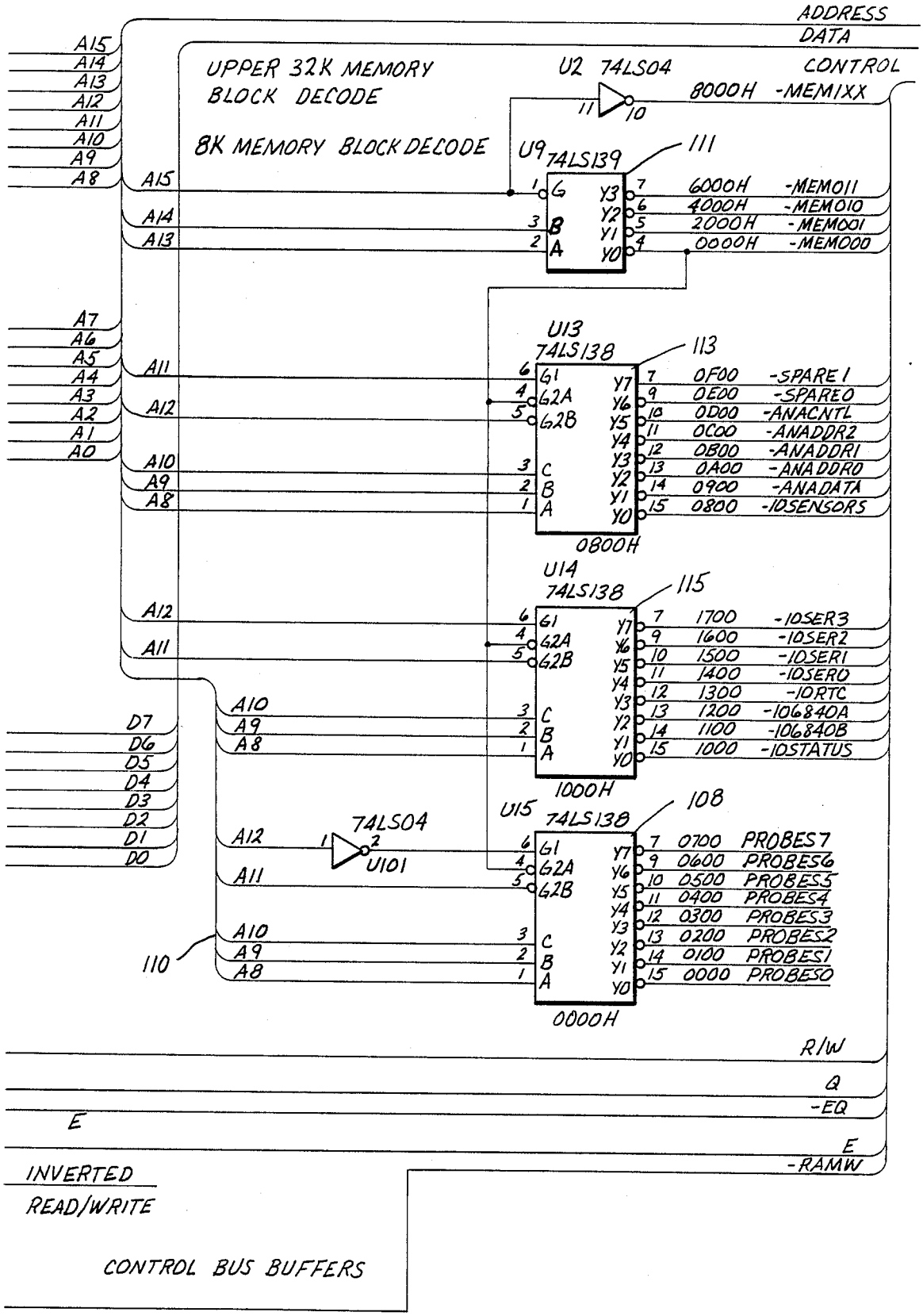

Considering now the CPU controller 50 in greater detail with respect to FIG. 3, it generally includes a single central processing unit chip 100, identified on the drawing as part number 6809E. The chip 100 is connected to the system bus 52, for controlling the operation of the master unit 33. A master oscillator circuit 102 produces a double rail 4 MHz outputs for the internal operation of the master module 33.

A wait state generator 104, and a CPU timing generator 106 generate the E and Q control signals for the CPU chip 100, for determining the processing time for the master module 33. A probe/address buffer 108 is connected to a buffer data bus 110, and to a series of memory chips, such as the chips 111, 113 and 115, for providing probe signals over eight probe leads, indicated as PROBES 0–7. As shown in FIG. 6, the probe leads PROBES 0–7 are connected to the probe bus driver/decoder boards 79, for monitoring continuously the status of the elevator shaft control 16.

Considering now the input/output serial ports 55, 57, 59 and 61, in greater detail, with respect to FIG. 4, they are generally similar, and therefore only the modem serial port 55 will be described hereinafter in greater detail. The serial port 55 generally includes an integrated circuit 120, which is identified as part number 6850. The serial port 55 further includes a plurality of integrated circuit chips such as the chips 122, 124 and 126, each one of which being identified as a RS232 component. The integrated circuit 120 includes an output lead 128 for sending an interrupt signal to the CPU controller 50, when a message if being formulated and compiled in the master module 33.

Considering now the LCD display board 72 in greater detail with respect to FIG. 5, it generally includes a series of light emitting diodes, such as the light emitting diodes 131, 133, 135, 137 and 139, controlled by a chip 138 for generating visual indications regarding the operational status of the master module 33, and the corresponding elevator shaft controls 16. In this regard, the light emitting diode 131, gives a visual indication whenever the access door (not shown) of the monitor module 12 is opened. The light emitting diode 131 is energized when a door switch 141 is actuated to send a ground signal to a chip 142, which, in turn, sends the indication back to the computer processor unit via the bus 52.

The illumination of the light emitting diode 133 indicates the occurrence of a system fault. When illuminated, the light emitting diode 135 indicates that the fault has been acknowledged by the remote station 26 or 28, such as the remote station 26. The light emitting diode 137 being illuminated indicates that the maintenance personnel is servicing the monitor device 12. The light emitting diode 137 is energized whenever a switch 143 is actuated by service personnel to send a ground signal via thumb switches 144 to the chip 142, and thus back to the computer processor unit.

In this regard, prior to the service personnel starting the maintenance of the elevator system, he or she actuates the switch 143, for interrupting the operation of light emitting diode 137, therefore, serves to warn the operator at the selected remote stations 26 or 28, that the particular master module 33 is being accessed and the corresponding elevator is being serviced. Furthermore, the actuation of the switch 143 prevents the generation of false alarms of the remote stations 26 or 28.

Also, when the switch 143 is actuated the monitor device 12, generates a signal indicative of the beginning of the maintenance period. Upon completion of the service call, the switch 143 is opened, and the device 12 generates another signal indicative of the end of the maintenance period. Thus, a permanent record is kept for the particular service call made. A light emitting diode 139 indicates that the modem 67 is being accessed, either from the remote stations 26 or 28, or internally by either one of the modules such as the master module 33 or the slave module 35 and 37.

A chip 132 serves as the probe bus address and control signal generators. In this regard, the chip 132 generates the address and control signals for the master module. Similarly, a chip 134 generates the probe bus data signals.

Considering now the probe bus driver/decoder unit 79 in greater detail with respect to FIG. 6, it generally includes a plurality of a decoder integrated circuits, such as the decoders 150 and 152. In the preferred form of the invention, four probe bus address leads PA0–PA3 serve to designate one or more decoders, such as the decoders 160 and 152, being accessed. The probe bus driver/decoder board 79 generally includes sixteen identical decoders identified as part numbers LS139.

A probe cable 154, contains eight probe leads PROBES 0–7, and is connected to sixteen identical AND logic gates, such as the gates 156 and 158. The output of each decoder, such as the decoder 150 is connected to a particular single AND logic gate, such as the logic gate 156. The output of each AND logic gate, such as the logic gate 156, is connected to a corresponding bus driver integrated circuit, such as the bus driver 81B, for monitoring the status of eight status lines, collectively indicated at 160.

The probe bus driver/decoder board 79 includes a total of 16 identical bus drivers, such as the bus drivers 81B, and 87B. Each one of the bus drivers is identified as part number LS244.

The output of each bus driver circuit, such as the bus driver circuit 81, includes eight leads collectively indicated at 162, which are connected to the system bus 52, for signaling the status of eight corresponding status lines to the CPU controller 50. While the described configuration can be designed to monitor up to 128 status lines ($16\times8$), the preferred embodiment of the master module 33, enables the monitoring of up to 100 status lines for 38 story buildings, or 50 status lines for smaller size buildings.

Considering now the elevator interface boards which are collectively indicated at 80, in greater detail with respect to FIGS. 6, they are generally identical, and are further connected to the input of the bus driver circuits such as the bus driver circuits 81B and 87B. Each one of the elevator interface boards 81, 83, 85 and 87 is connected to four corresponding bus driver circuit boards.

Also, each one of the elevator interface boards such as the board 81, includes eight optical coupler devices, such as the devices 162, 164, 166 and 168, and is connected to one input of the bus driver integrated circuit, such as the bus driver integrated circuit 81B. Thus, according to the preferred embodiment, 25 identical optical coupler devices are connected to four probe bus driver circuits, and 100 optical coupler devices are connected to the probe bus driver decoder unit 79. Each single input of the input to the elevator interface boards 80 is connected to a particular status lead of the shaft controls 16.

The monitor device 12 has the capability of recognizing four types of fault conditions, the automatic fault condition, the timed fault condition, the conditional fault condition and the potential fault condition. The automatic fault condition is one which, upon detection, is confirmed as a fault condition. An example of an automatic fault condition is an indication that the up or down limit has been exceeded.

A timed fault condition is one which, upon detection, gives an indication as to the presence of a condition which by itself is not a fault, but which should be interpreted as a fault condition, if the indication is extended for a relatively long period of time. An example of a timed fault is an indication that the safety edge of the door is pressed, or that the relevel indicator is activated.

A conditional fault condition, is one where the simultaneous occurrence of two fault conditions, such that the presence of only one of the conditions is not a fault condition by itself. An example of such conditional fault is an elevator car not moving because the door is opened. Or the door will not open after the car stopped.

Another type of fault condition is indicative of selected potential problems. For instance, when a certain sequence of signals is detected, this may not be a fault condition by itself, but may indicate a potential problem. So, if a fault indicator is activated and then deactivated, then the fault condition may be intermittent, but the cause of such fault remains undetected.

Turning now to the following Table A, there is shown a non-exclusive listing of some fault conditions which are detectable by the monitor device 12:

TABLE A

| | |
|---|---|
| 1. Door locks | 16. MG Run |
| 2. Gate Switch | 17. MG Timer |
| 3. Stop Switch | 18. Overload |
| 4. Gov Switch | 19. RPR |
| 5. Seismic Trip | 20. Control Fuse |
| 6. Alarm Button | 21. Re-level |
| 7. Fire Service | 22. Emergency Power |
| 8. Inspection | 23. Selector |
| 9. Independent Service | 24. Slack Cable |
| 10. Photo Cell | 25. Motor Temp |
| 11. Safety Edge | 26. Gearbox Temp |
| 12. Up Normal Limit | 27. Car Speed |
| 13. Down Normal Limit | 28. Door Motor Fuse |
| 14. Up Pilot | 29. Brown Out |
| 15. Down Pilot | 30. Stuck Car Call |

Turning now to the following Table B, there is shown a sample format generated at the printers 39 or 47:

TABLE B

FAULT REPORT

| | * IDENTITY * | * FAULT * | * POSITION * |
|---|---|---|---|
| * 0050 * Customer #1 | #5 Service time: 12:53:22 date: 10/09/86 | Gate Switch | 12 Acknowledged |
| * 0065 * Customer #2 | #2 time: 12:53:42 date: 10/09/86 | Low oil | 1 Acknowledged |
| * 0071 * Customer #3 | #3 time: 12:54:02 date: 10/09/86 | Up Limit (ALARM) | 3 Acknowledged |
| * 0101 * Customer #4 | #4 time: 13:21:33 date: 10/09/86 | Elec. Eye | 9 Acknowledged |
| * 0043 * Customer #5 | #6 time: 13:25:46 date: 10/09/86 | Control Fuse | 21 Acknowledged |
| * 0071 * Customer #6 | #3 time: 13:27:01 date: 10/09/86 | Status normal | Acknowledged |
| * 0050 * Customer #7 | #5 service time: 13:29:06 date: 10/09/86 | Status normal (Cleared) | Acknowledged |

If the fault condition is acknowledged by the computing device 46 or 48, then the remote station 26, or 28 sets a flag to instruct the master module 33 to not send fault messages. Copies of the compiled message reports are then sent to appropriate printers, such as the printers 39 and 47.

Referring now to the remote station 26, in greater detail, a copy of the program, stored on a floppy disk, is installed onto a hard disk 35, on a personal computer such as the Kaypro PC30 or EXP. The computer 43, may be the one manufactured by Kaypro as Model No. PC30 or EXP. The printer 47 may be the one manufactured by Panasonic as Model No. 1080I, or by Star as part number NP-10.

Considering now FIGS. 7–19 there is shown detailed flowcharts of the routine computer software programs, as executed by the computing devices 48 and 49. Each one of these routines will now be described in greater detail.

SERVICE OFFICE

Figure 7:
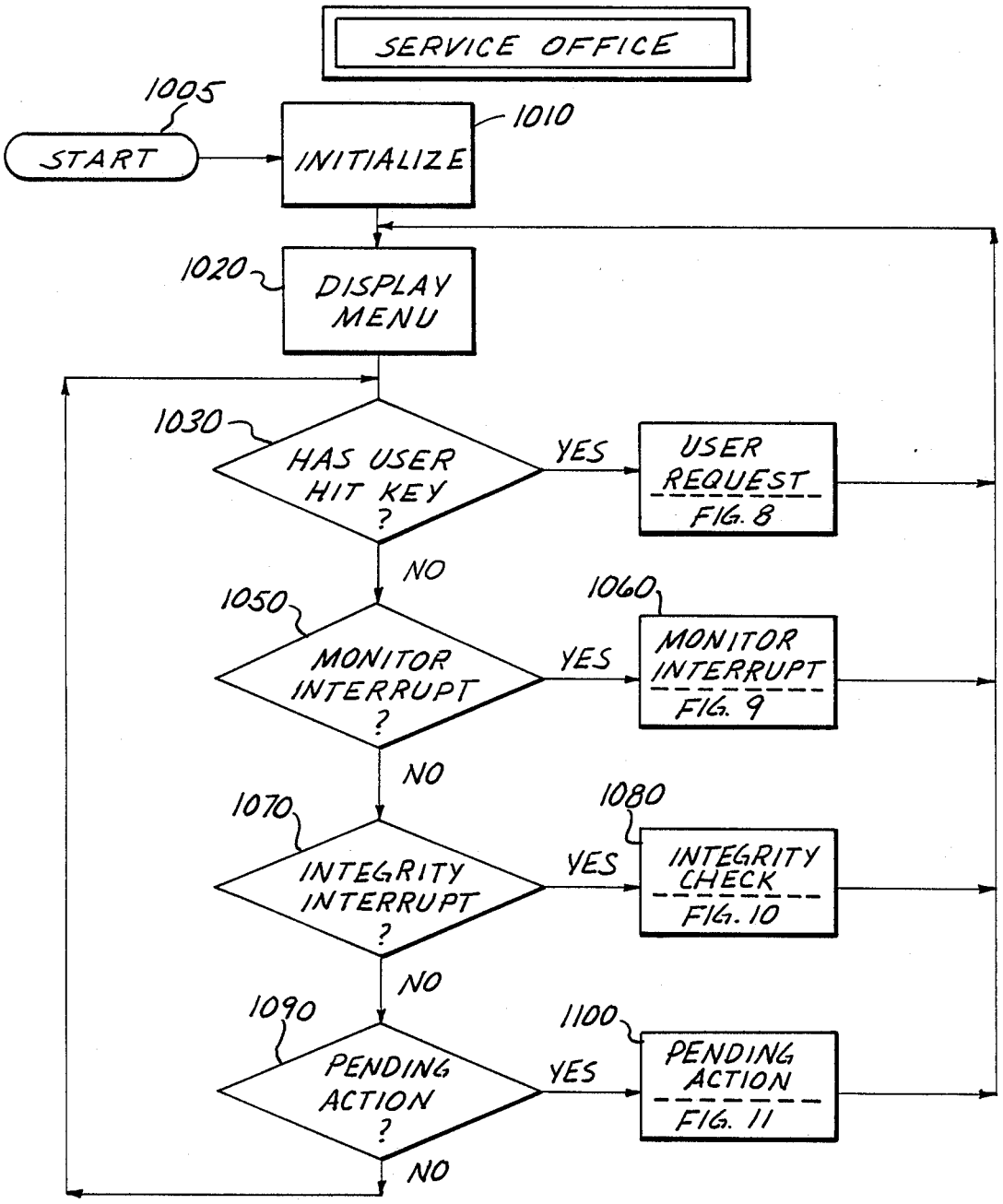
FIGS. 7–19 are detailed flowcharts of the computer software programs, as executed by remotely located computers of the system of FIG. 1.

Considering now the SERVICE OFFICE routine, with respect to FIG. 7, it commences at 1005. As indicated at 1010, the system parameters are initialized for "start-up" and the scheduled actions portion of the data base is established. The Service Office program is then ready to accept input from various sources. As indicated at 1020, the service menu is displayed on the monitor.

As indicated at 1030 the software then determines whether a key has been depressed on the keyboard. If it has, then a USER REQUEST routine is executed at 1040, as will be discussed later in greater detail, with respect to FIG. 8, and the menu is then displayed once again at 1020.

As indicated at 1050, if the user has not depressed a key on the system keyboard, then the software determines whether an interrupt signal has been received from the monitor device 12. If an interrupt signal has been received, then the MONITOR INTERRUPT routine is executed, as will be discussed later in greater detail, with respect to FIG. 9, as indicated at 1060, and the menu is then displayed at 1020.

As indicated at 1070, if an interrupt signal has not been received, then the software determines whether a timed or scheduled integrity check interrupt signal is detected. As indicated at 1080, if an integrity check interrupt signal is detected, then the INTEGRITY CHECK routine is executed, as will be discussed later in greater detail with respect to FIG. 10, and the menu is then displayed at 1020.

If on the other hand, an integrity check interrupt signal has not been detected, then, as indicated at 1090, the software determines whether there are any pending actions for unacknowledged system error messages or unacknowledged service calls.

As indicated at 1100, if a pending action is present, then, as indicated at 1100, the PENDING ACTION routine is executed, as will be described later in greater detail with respect to FIG. 11, and the menu is then displayed at 1020. If no pending action is present, then the software determines once again whether the user has depressed a key on the system keyboard, as indicated at 1030.

USER REQUEST

Figure 8:
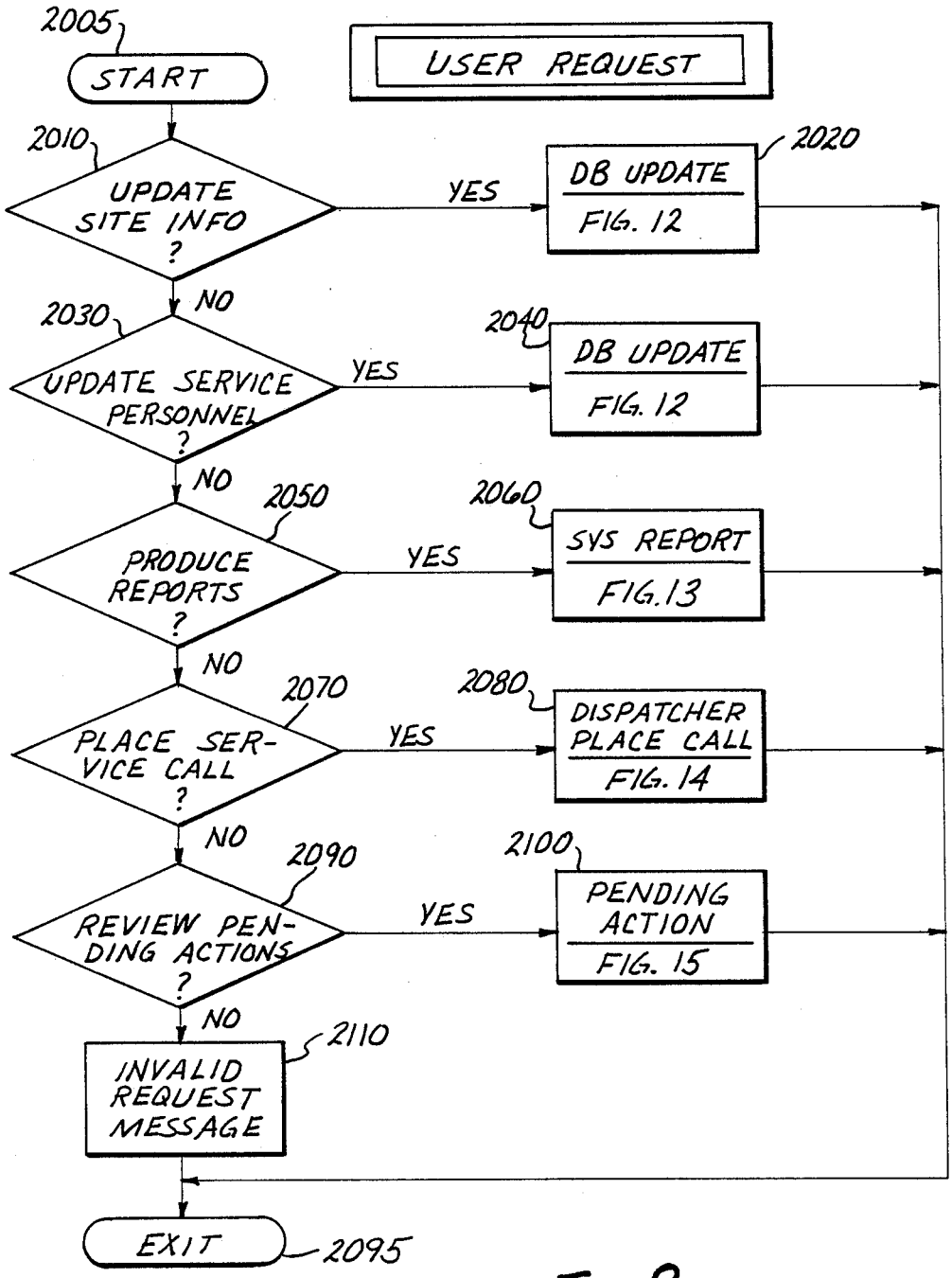

Considering now the USER REQUEST routine with respect to FIG. 8, it commences at 2005. As indicated at 2010, the software determines whether the user has requested site information update. If site information update has been requested, then, as indicated at 2020, a DB UPDATE routine is executed, as will be discussed later in greater detail with respect to FIG. 12, and is then terminated at 2095.

As indicated at 2030, if a site information update has not been requested, then the software determines whether a service personnel update is requested. If a service personnel updated is requested, then as indicated at 2040, the DB UPDATE routine is executed, as will be discussed later in greater detail with respect to FIG. 12, and is terminated at 2095.

As indicated at 2050, the software determines whether the user has requested the production of information reports from the data base. If such reports have been requested, then, as indicated at 2060, a SYS REPORT routine is executed, as will be discussed later in greater detail with respect to FIG. 13, and is terminated at 2095.

If the production of information reports have not been requested, then, as indicated at 2070, the software determines whether the user has originated a service call. If the user has originated a service call, then as indicated at 2080, a DISPATCHER PLACE CALL routine is executed, as will be discussed later in greater detail with respect to FIG. 14, and is terminated at 2095.

If the user has not originated a service call, then, as indicated at 2090, the software determines whether the user has requested to review and to modify the pending system actions. If the user has requested to review and to modify such actions, then, as indicated at 2010, a PENDING ACTION routine is executed, as will be discussed later in greater detail with respect to FIG. 13, and is terminated at 2095.

If the user has not requested to review and to modify the pending system actions, then as indicated at 2110, an error message is generated, and the USER REQUEST routine is terminated at 2095.

MONITOR INTERRUPT ROUTINE

Figure 9:
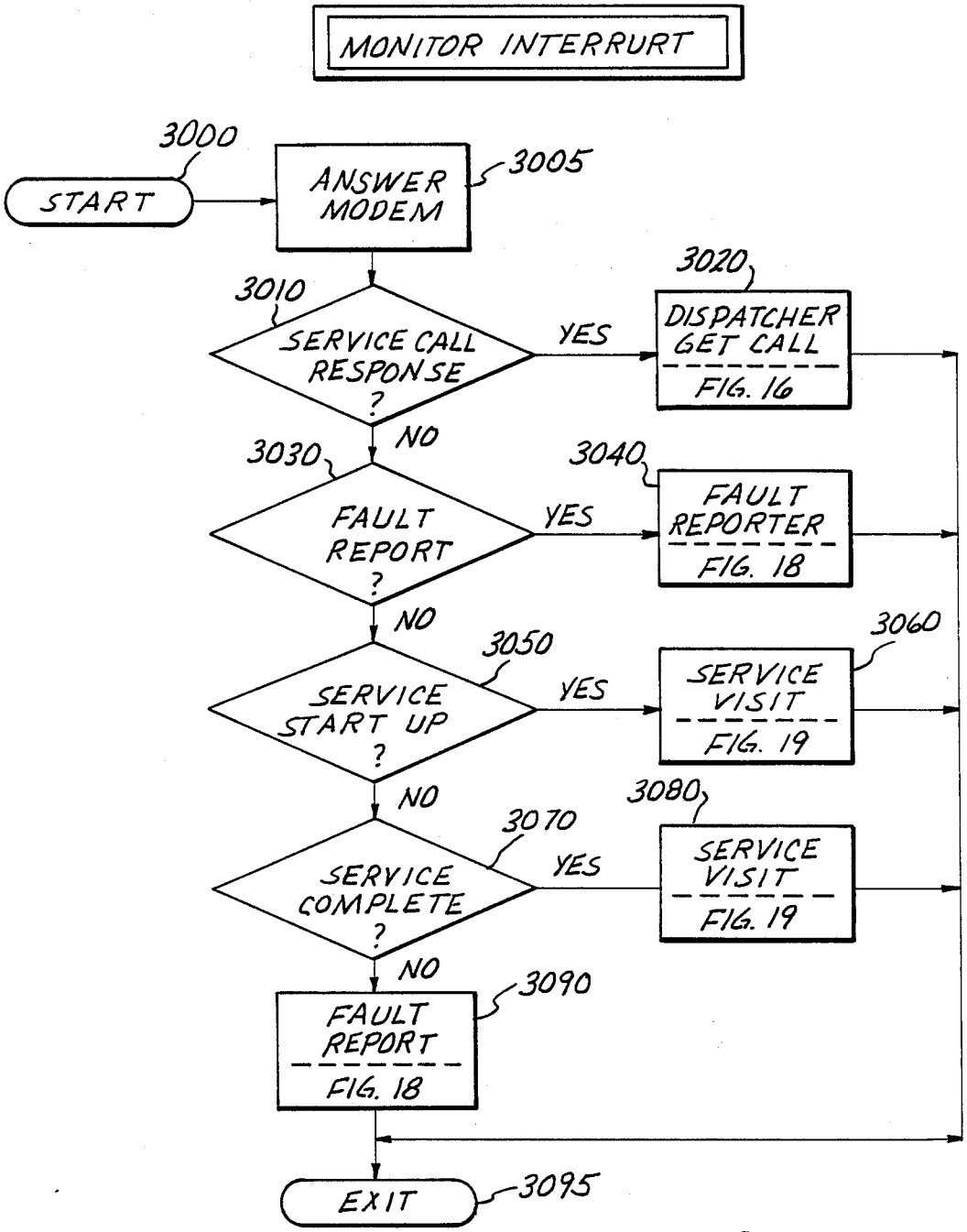
Figure 10:
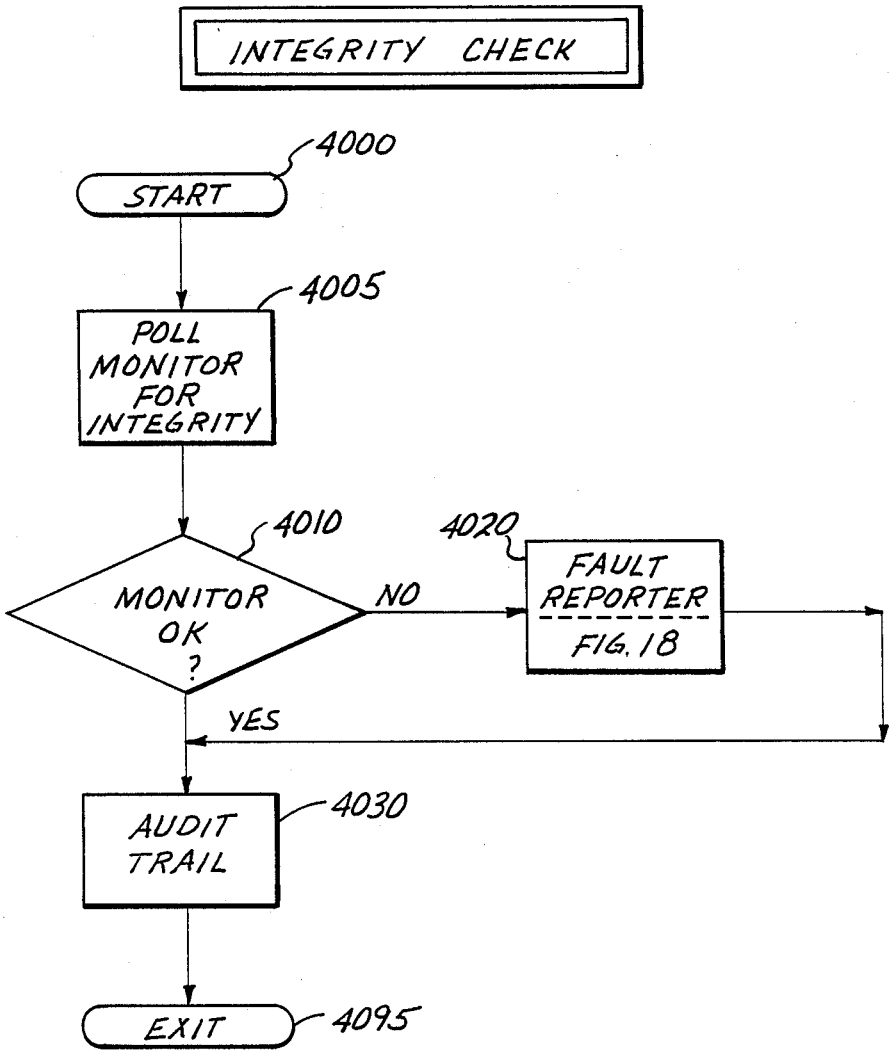

Considering now the MONITOR INTERRUPT routine with respect to FIG. 9, it commences at 3000 with the operation of the monitor device 12 being interrupted by the modem 67, and with the reading of the call information from the modem 67, as indicated at 3005.

As indicated at 3010, the software determined whether the call has been placed by a service technician in response to a service request. If it has been, then, as indicated at 3020, a DISPATCHER GET CALL routine is executed, as will be discussed later in greater detail with respect to FIG. 16, and is then terminated at 3095.

If the call has not been placed by a service technician, then as indicated at 3030, the software determines whether the call has been placed from the site or building where the monitor device 12 is installed. If it is, then, as indicated at 3040, a FAULT REPORTER routine is executed, as will be discussed later in greater detail with respect to FIG. 18, and is terminated at 3095.

If the fault report has not originated from the monitor device 12, then, as indicated at 3050, the software determines whether the service technician has placed the device 12 in a start up or service mode. If he or she has, then as indicated at 3060, a SERVICE VISIT routine is executed, as will be discussed later in greater detail with respect to FIG. 19, and is terminated at 3095.

If a service start up call has not been placed, then as indicated at 3070, the software determines whether the service has been completed, and the service technician has changed the state of the device 12 from the service mode to the normal mode. If the service is completed, then, as indicated at 3080, a SERVICE VISIT routine is executed, as will be discussed later in greater detail with respect to FIG. 19, and is then terminated at 3095.

If the service has not been completed, then a fault message is indicated at 3090, and the MONITOR INTERRUPT routine is terminated at 3095.

INTEGRITY CHECK

Figure 4:
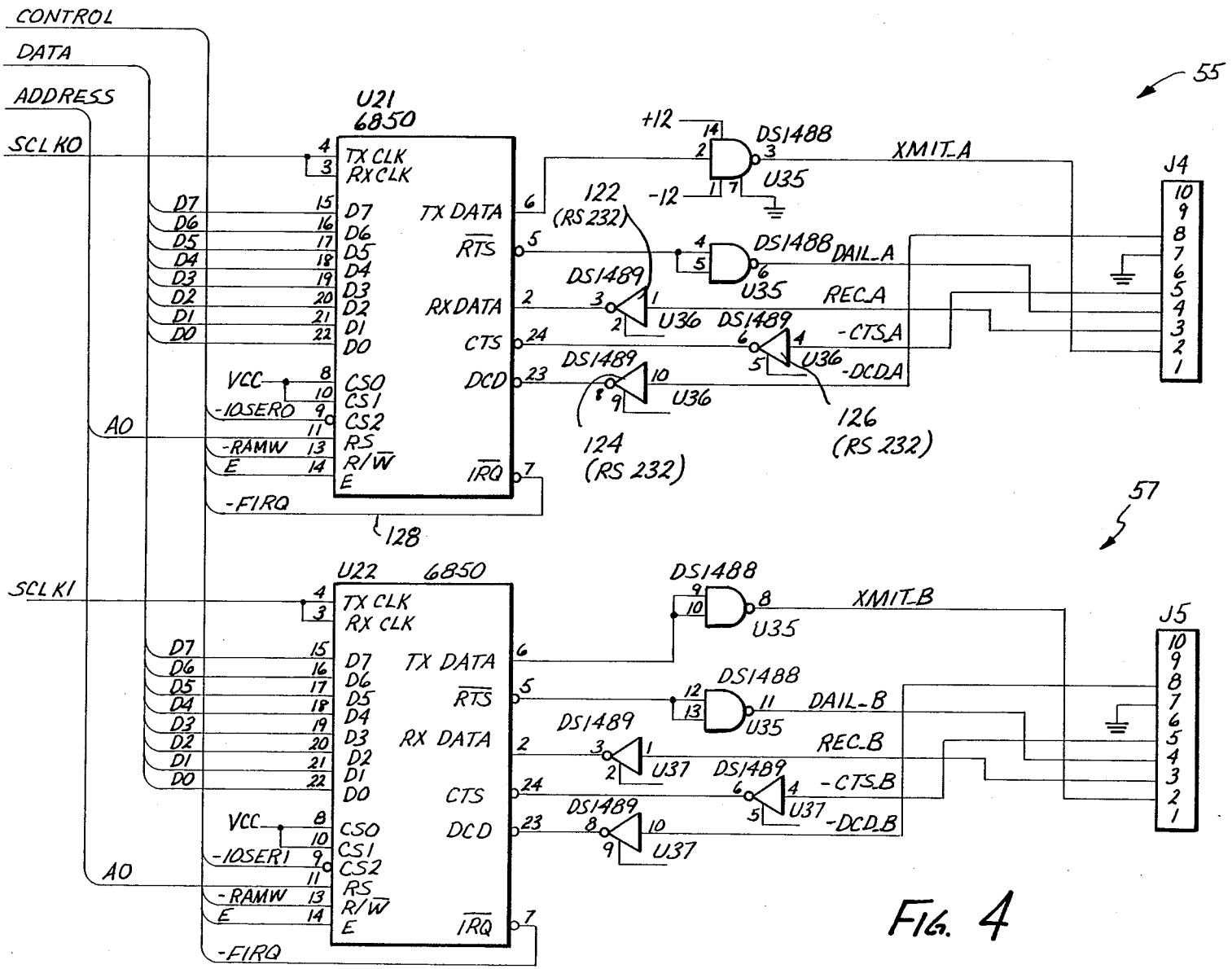
FIG. 4 is a circuit diagram of a pair of serial ports, which form a part of the master module of FIG. 2.

Considering now the INTEGRITY CHECK routine in greater detail with respect to FIG. 4 it commences at 4000, in response to an interrupt signal from the hardware system clock, signaling the system that a scheduled integrity check of the device 12 will be performed. As indicated at 4005, the operator at the remote station 26 places a call to the device 12 via the modem 67, for establishing a two-way communication.

As indicated at 4010, the software determines whether the monitor is properly operational. If the monitor device 12 is properly operational, then as indicated at 4020, a FAULT REPORT routine is executed as will be described later in greater detail with respect to FIG. 15, and the system will make an entry in the Audit Trail that the check has been performed, as indicated at 4030.

If the monitor device 12 is not properly operational, then, as indicated at 4030 the system will make an entry in the Audit Trail that the check has been performed, and the INTEGRITY CHECK routine is terminated at 4095.

PENDING ACTION

Figure 11:
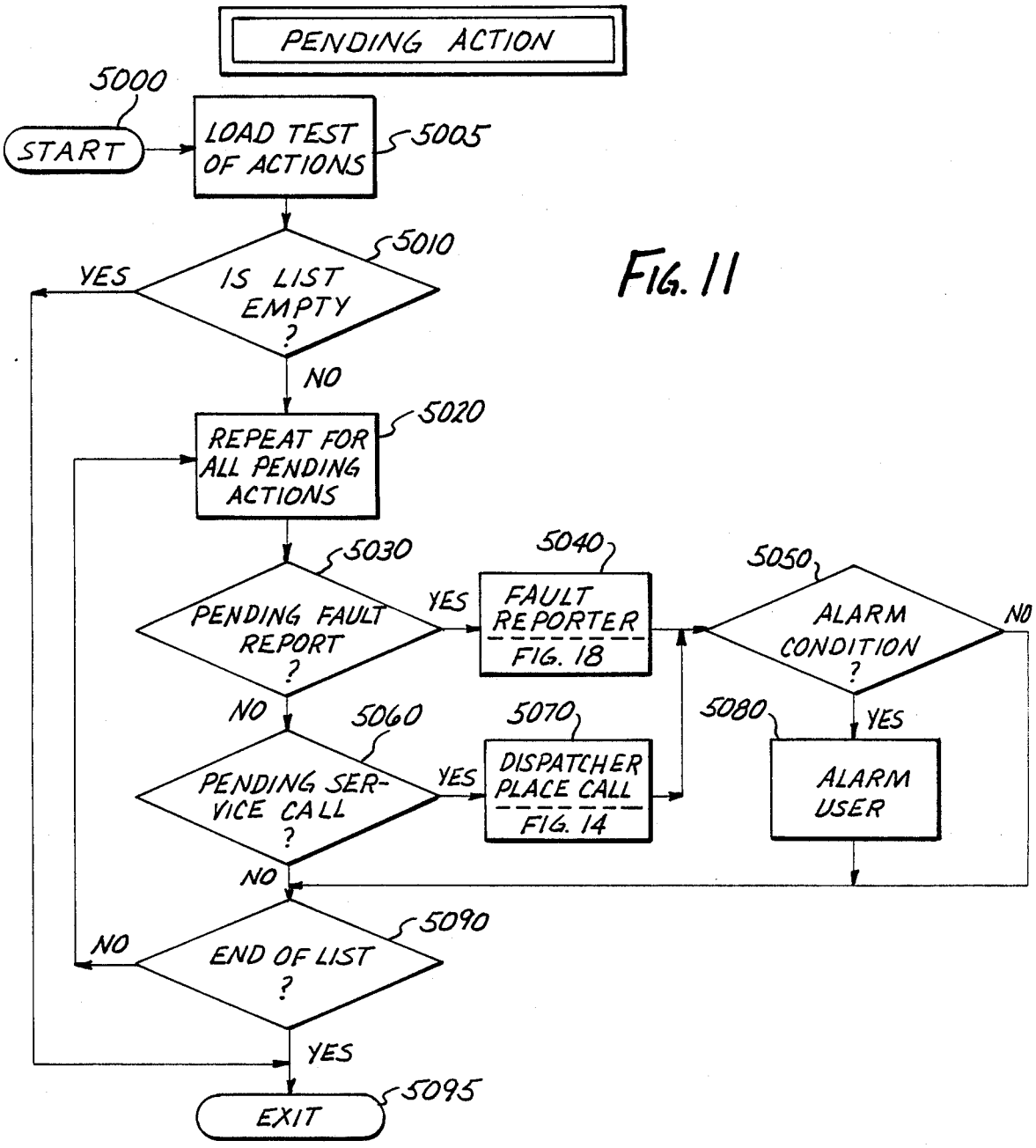

Considering now the PENDING ACTION routine in greater detail with respect to FIG. 11, it is invoked periodically by the system to review and to make decisions regarding the disposition of unacknowledged system error messages, and unacknowledged service calls. The PENDING ACTION routine commences at 5000, with the loading of the list of actions, as indicated at 5005.

As indicated at 5010, if there are no pending actions in the list, then, the PENDING ACTION routine is terminated at 5095. If there are pending actions in the list, then as indicated at 5020, the system repeats the following subroutine for every individual pending action:

As indicated at 5030, the software determines whether there is a pending fault report which has exceeded the required response time. If there is such a PENDING FAULT report, then, as indicated at 5040, a FAULT REPORTER routine is executed at 5040, and as indicated at 5050, the software determines whether there is a situation which requires a user alarm.

If no such situation is detected, then, the software determines whether all pending actions have been processed, as indicated at 5090. If all pending actions have been processed, then the PENDING ACTION routine is terminated at 5095. If not all the pending actions have been processed, then the foregoing subroutine is repeated at 5020.

As indicated at 5080, if the detection situation requires a user alarm, then an alarm (not shown) will be activated, and the software will determine once again whether all the pending actions have been processed, as indicated at 5090, and the foregoing subroutine is repeated as needed, as indicated at 5020.

As indicated at 5060, if a pending service call is detected but could not be responded to, then, as indicated at 5070 a DISPATCHER PLACE CALL routine is executed, as will be discussed later in greater detail with respect to FIG. 14, and the software determines once again whether the detected situation requires a user alarm, as indicated at 5050, and the foregoing subroutine is repeated. If, as indicated at 5090, no pending service call is detected, then, the software determines once again whether there is a pending action in the list. If no such pending action is detected, then, as indicated at 5095, the PENDING ACTION routine is terminated.

DB UPDATE

Figure 12:
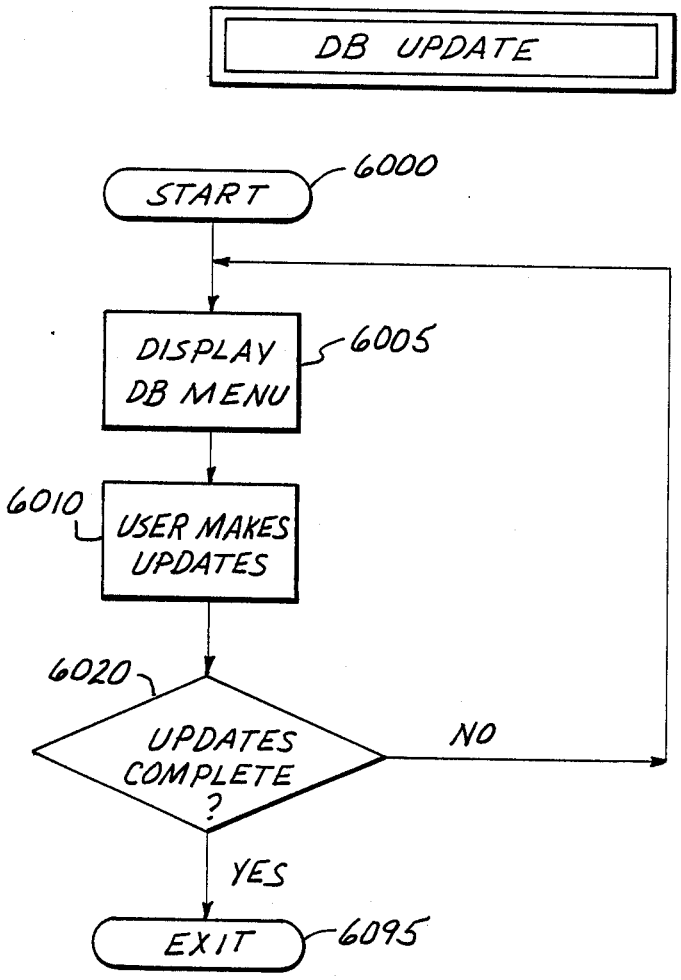

Considering now the DB UPDATE routine in greater detail with respect to FIG. 12, it generally allows the user to maintain the information stored in the data base. The DB UPDATE routine starts at 6000 with the display of the DB Menu, as indicated at 6005. As indicated at 6010, the user selects the desired update option, and as indicated at 6020, the software determines whether the selected update has been completed. If it has not, then the DB Menu is displaced once again at 6005. If all the updates have been completed, then the DB UPDATE routine is terminated at 6095.

SYS REPORT

Figure 13:
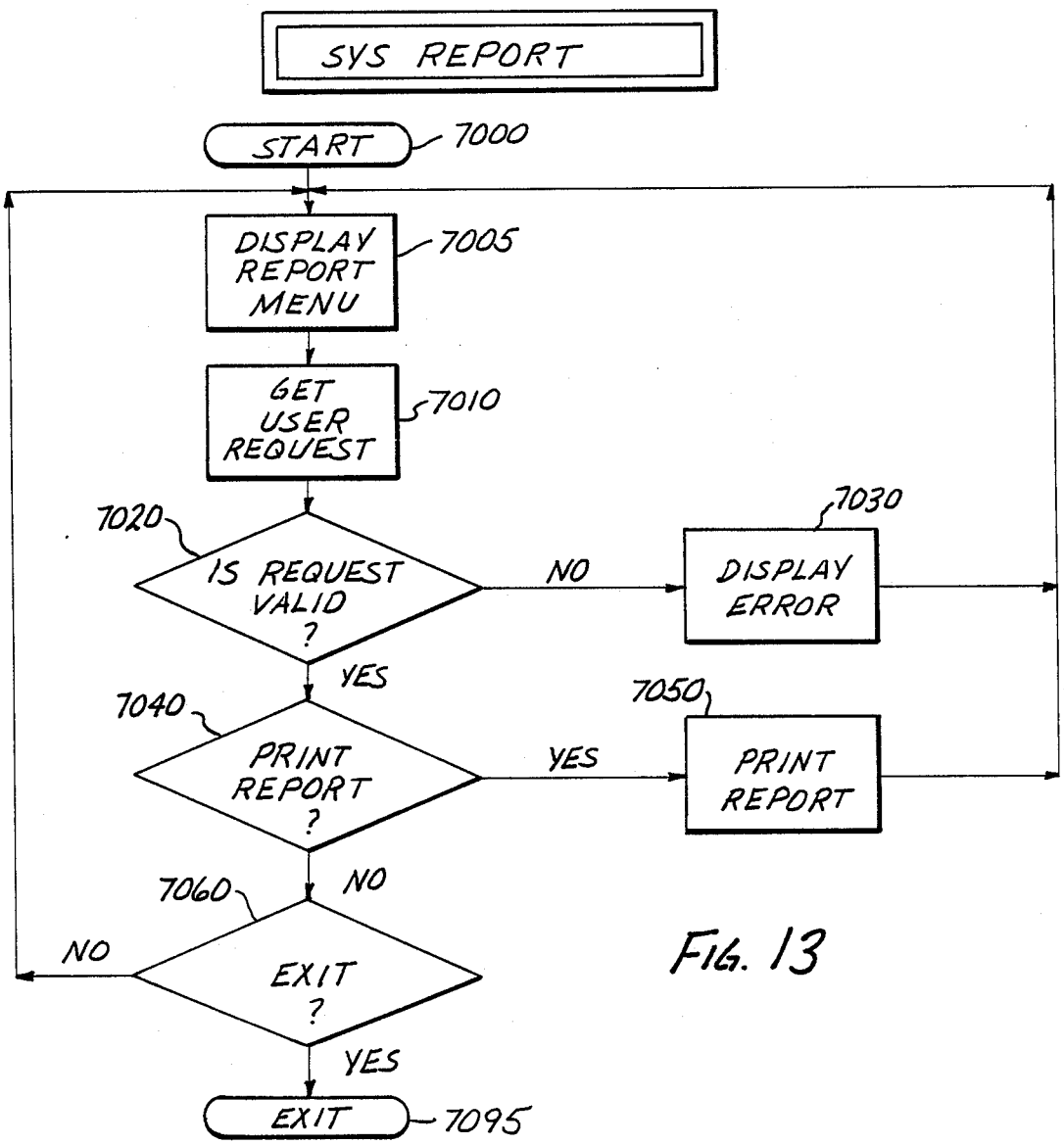

Considering now the SYS REPORT routine in greater detail with respect to FIG. 13, it generally generates reports of the information in the data base. The SYS REPORT routine commences at 7000 by displaying the SYS REPORT Menu, as indicated at 7005. The user than places his or her request at 7010.

As indicated at 7020, the software determines whether the user's request is valid. If it is not, then as indicated at 7030, an error message is displayed on the monitor, and the SYS REPORT Menu is displayed once again.

If the user's request is valid, then, as indicated at 7040, the software determines whether the user has requested a printed report. If he or she has, then, as indicated at 7050 the report is printed, and the SYS REPORT Menu is displayed once again.

If the user has not requested a printed report, then, as indicated at 7060 the software determines whether the user has selected to terminate the SYS REPORTS routine. If the user has selected not to terminate the routine, then the SYS REPORT Menu is displayed once again. If, on the other hand the user has selected to terminate the routine, then the SYS REPORT routine is terminated at 7095.

DISPATCHER-PLACE CALL

Figure 14:
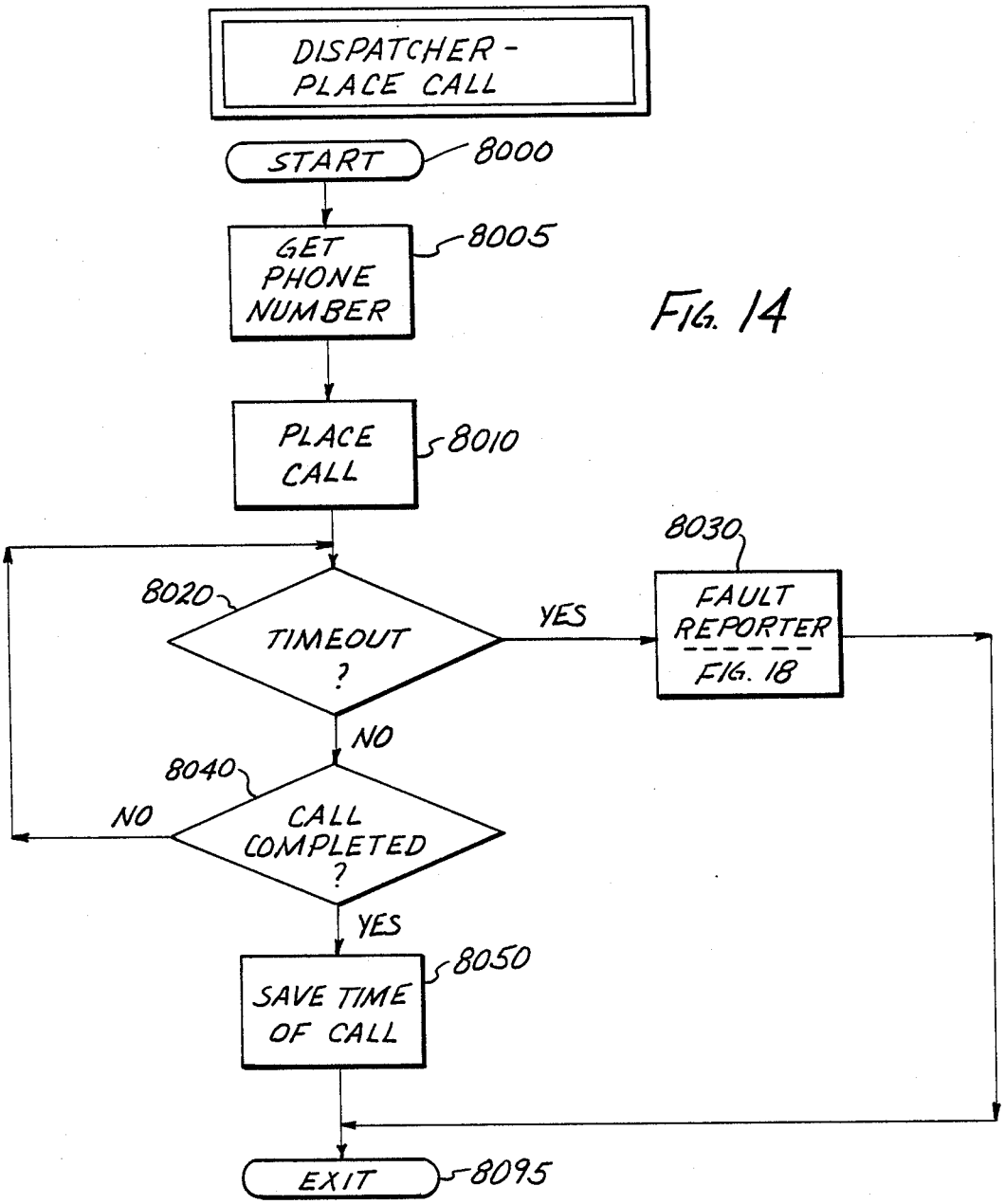

Considering now the DISPATCHER-PLACE CALL routine in greater detail with respect to FIG. 14, it is generally used to notify the service technician of a service call The DISPATCHER-PLACE CALL routine starts at 8000, by searching for the service technicians phone number at 8005, and by placing a corresponding telephone call via the modem 67, to a beeper message service (not shown), as indicated at 8010.

As indicated at 8020, the software determines whether a "time-out" has occurred. If it has, then, as indicated at 8030, a FAULT REPORTER routine is executed, as will be described later in greater detail with respect to FIG. 18, and the DISPATCHER-PLACE CALL routine is terminated at 8095. If a "time-out" has not occurred, then as indicated at 8040, the software determines whether a call has been completed. If the call has not been completed, then the software determines once again whether a "time-out" has occurred, at 8020.

If the call has been completed, then, as indicated at 8050 the system stores the time of the call in the data base, and the DISPATCHER-PLACE CALL routine is terminated at 8095.

REVIEW PENDING

Figure 15:
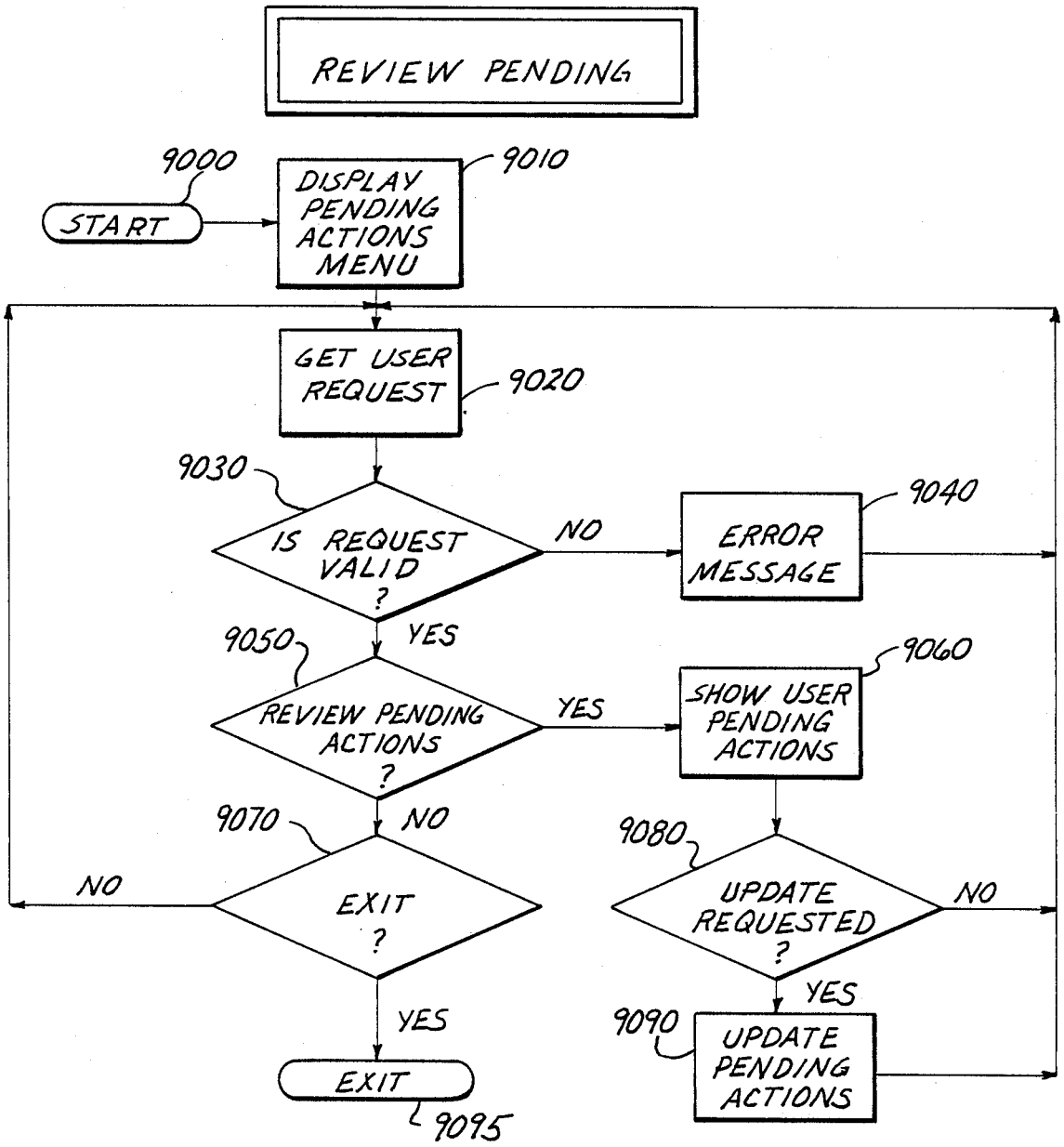

Considering now the REVIEW PENDING routine in greater detail with respect to FIG. 15, it generally displays and allows the user to review and to change all pending actions in the system. The REVIEW PENDING routine starts at 9000, by displaying the pending actions menu at 9010.

As indicated at 9020, the user inputs his or her request. As indicated at 9030, the software determines whether the user's request is valid. If the user's request is not valid, then as indicated at 9040 an error message is displayed, and as indicated at 9020 the user makes another request.

If the user's request is valid, then as indicated at 9050, the software determines whether the user has requested to review the pending actions. If the user has requested to review such pending actions, then as indicated at 9060, then all the pending actions will be displayed, and as indicated at 9080 the software determines whether the user can update any of these pending actions. If the user cannot make such an update, then the user makes another request at 9020. If the user can make the update, then as indicated at 9090 the user updates the pending actions, and he or she enters another request, at 9020.

If the user has not requested to review the pending actions, then as indicated at 9070, the software determines whether the user has requested to terminate the REVIEW PENDING routine. If the user does not wish to terminate the routine, then he or she may enter another request at 9020. If on the other hand the user has requested to terminate the REVIEW PENDING routine, then as indicated at 9095, such routine is terminated.

DISPATCHER-RECEIVE CALL

Figure 16:
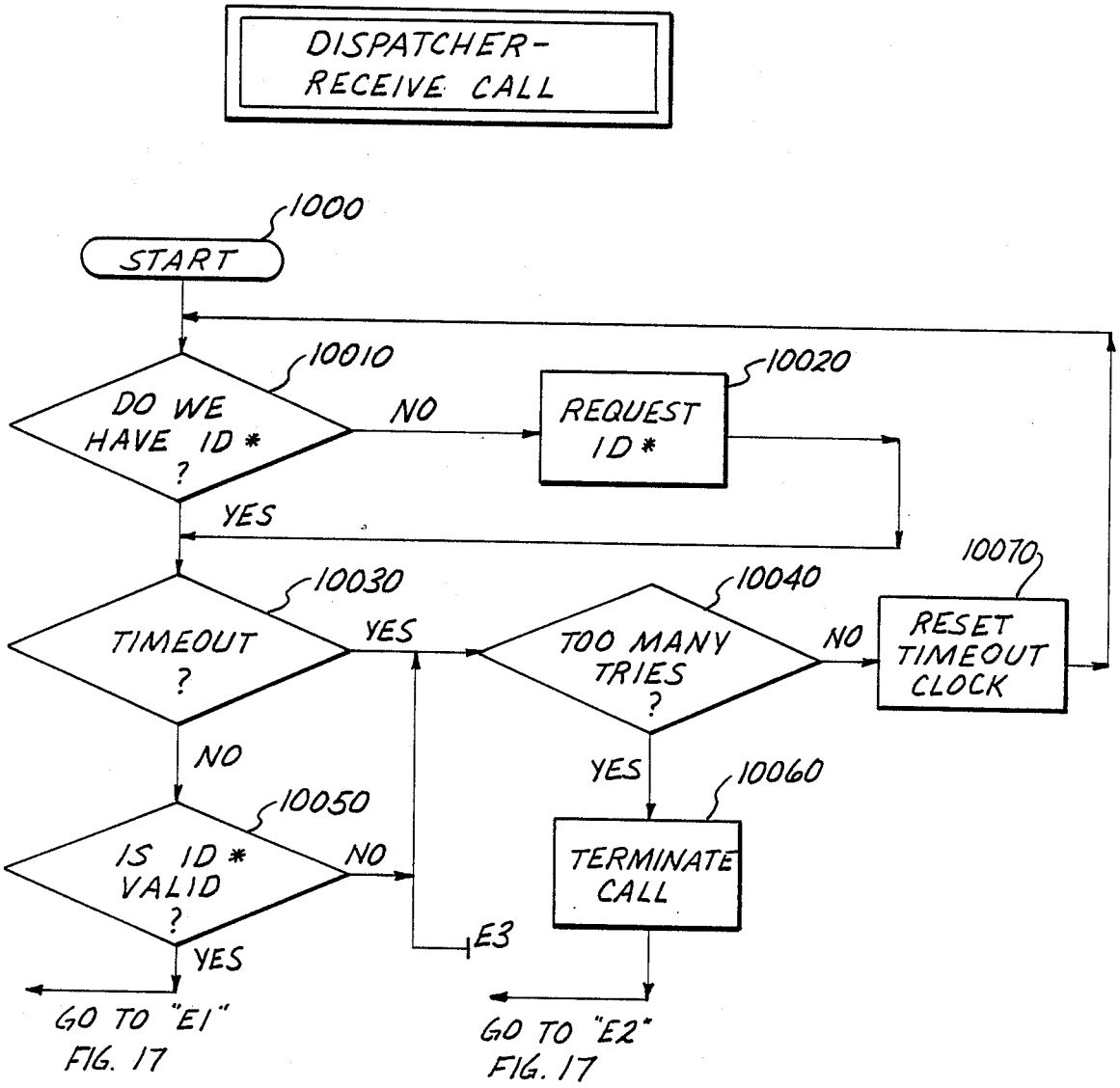
Figure 17:
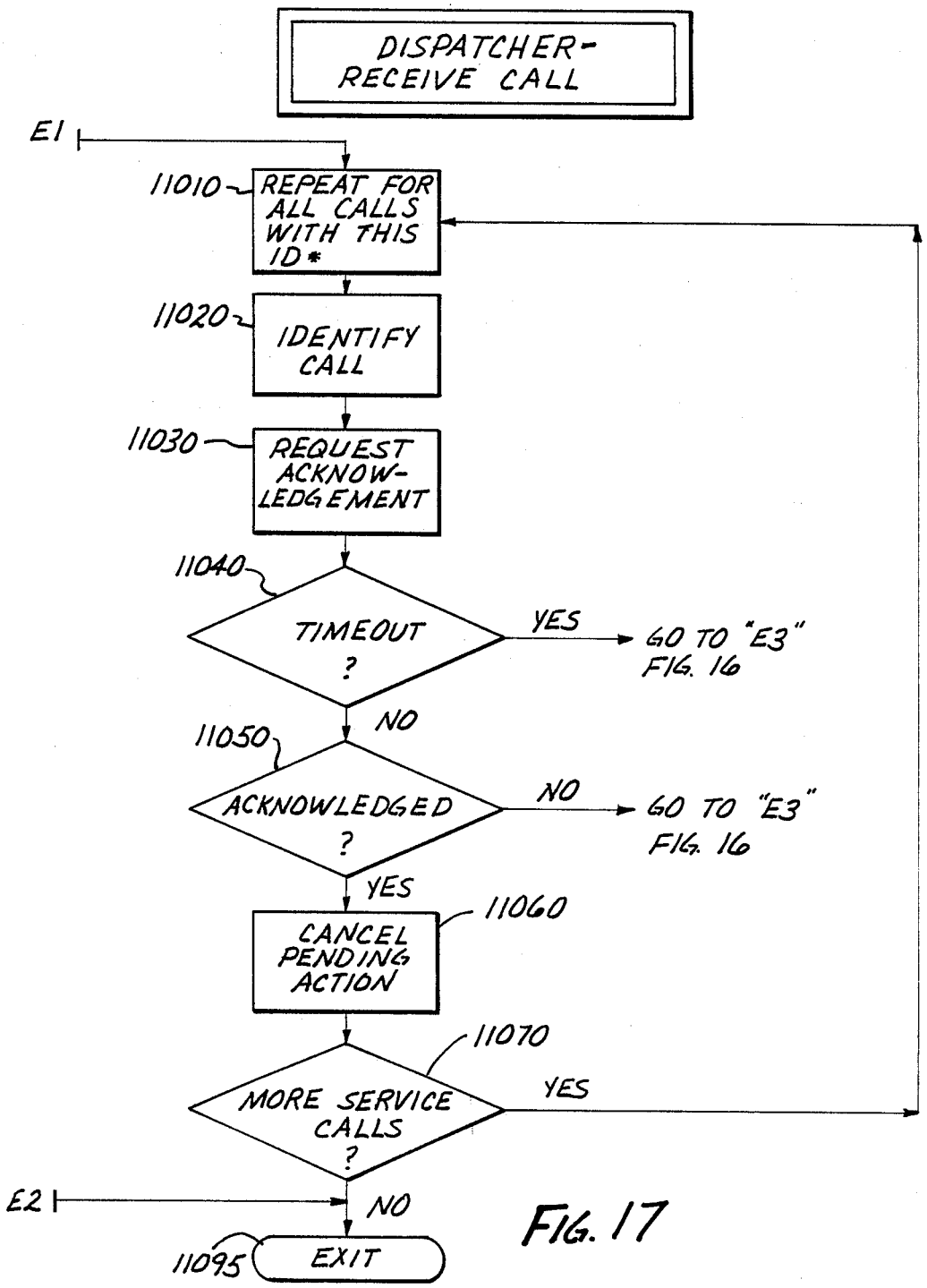

Considering now the DISPATCHER-RECEIVE CALL routine in greater detail with respect to FIGS. 16 and 17, it is generally utilized to inform the service technician of the service calls via a voice synthesizer (not shown) and the modem 67. The DISPATCHER-RECEIVE CALL routine commences at 10005, with the software determining whether a service technician's identification has been inserted. If no such identification number has been inserted, then an identification is requested at 10020, and the software determines whether a response has been received to this request, at 10030.

If a response has been received, then as indicated at 10040 the software determines the number of attempts made to enter the identification number. If the number of attempts exceeds a predetermined limit, then as indicated at 10060 the call is terminated, and the DISPATCHER-RECEIVE CALL routine is terminated at 11095.

As indicated at 10070, if the number of attempts does not exceed the predetermined limit, then the system resets the time-out clock (not shown), and the software determines once again whether an identification number is available, at 10010.

As indicated at 10050, the software determines whether the identification number is valid. If it is not, then the software determines once again the number of attempts made to enter the identification number at 10040, and the foregoing subroutine is repeated. As indicated at 11010, if the identification number is valid, then the system repeats the following subroutine for all pending calls for the particular service technician identified by the inputted identification number:

As indicated at 11020, the system identifies the service call via the voice synthesizer, and requests the technician to acknowledge the call, at 11030. As indicated at 11040, the software determines whether the technician has responded to the acknowledgement request at 11030, within a predetermined time. If the user has not responded within the predetermined time, then as indicated at 10040, the software determines once again the number of attempts made, and the foregoing subroutine is repeated.

If on the other hand the response to the acknowledgement request at 11030 has been inputted within a predetermined time limit, then, as indicated at 11050, the system accepts the input from the technician, and the software determines whether the call is acknowledged. If the call is not acknowledged, then as indicated at 10040, the software determines once again the number of attempts made, and the foregoing subroutine is repeated.

If, on the other hand the call is acknowledged, then, as indicated at 11060 the system cancels the pending action, and, as indicated at 11070 the software determines whether there are any other pending service calls. In which case, the foregoing subroutine is repeated, as indicated at 11010. If the software does not detect any other pending service calls, then the DISPATCHER-RECEIVE CALL is terminated at 11095.

FAULT REPORTER

Figure 18:
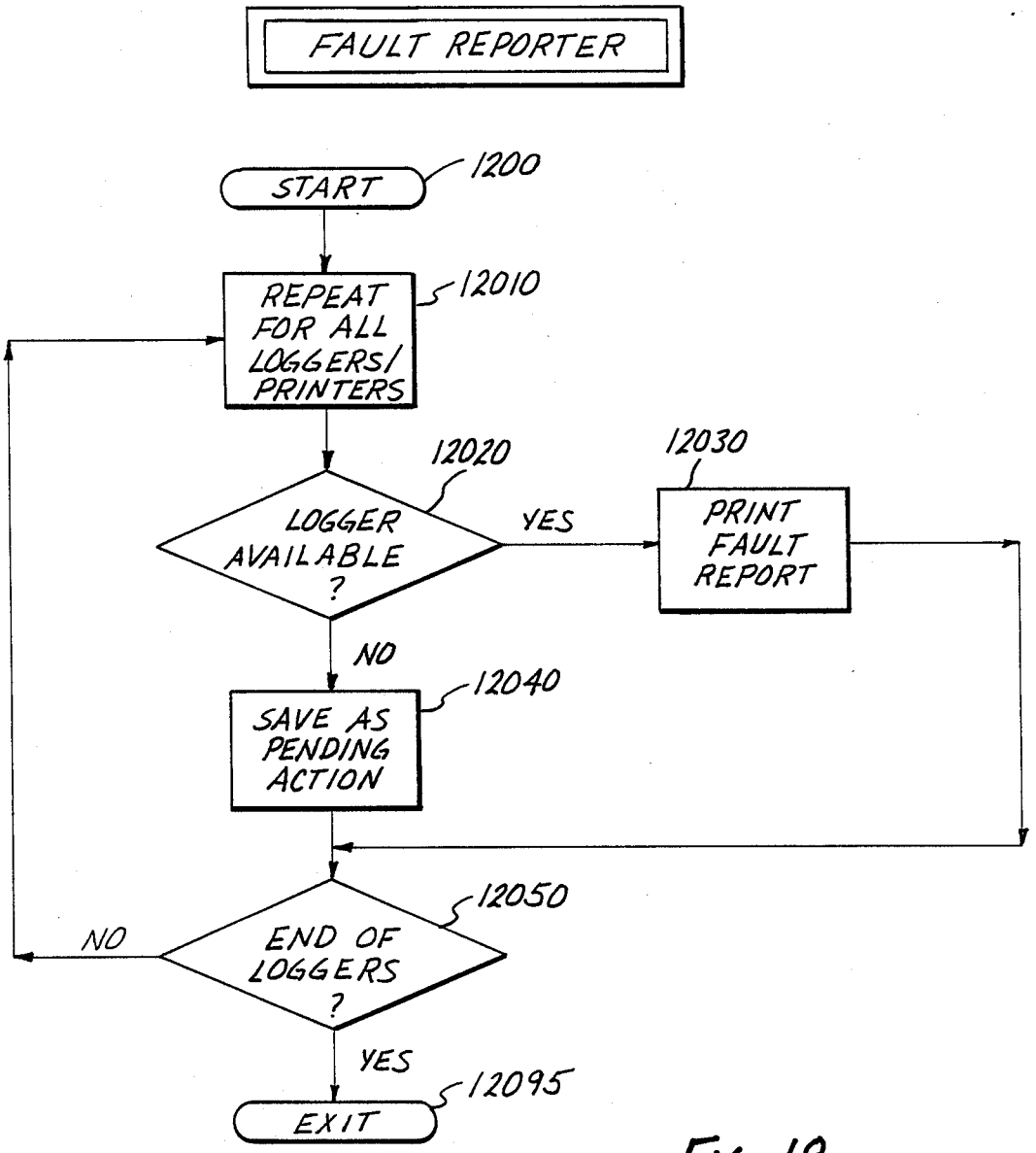

Considering now the FAULT REPORTER routine in greater detail with respect to FIG. 18, it generally reports fault conditions, in the device 12 and the system 10. The FAULT REPORTER routine commences at 1200, by repeating the following subroutine, as indicated at 12010:

As indicated at 12020, the software determines whether the logger or printer to which the report is to be sent is available for the receiving and printing such report. If the particular logger or printer is available, then as indicated at 12030, the fault report is printed, and the software determines whether all the loggers have been tried, at 12050. If all the loggers have not been tried, then the subroutine at 12010 is repeated.

As indicated at 12040, if a logger is not available, then the system saves the fault report as a pending action, and the software determines once again at 12050, whether all the loggers or printers have been tried. If all the loggers have not been tried, then the foregoing subroutine is repeated as indicated by 12010. If all the loggers have been tried, then the fault reporter is terminated at 12095.

SERVICE VISIT

Figure 19:
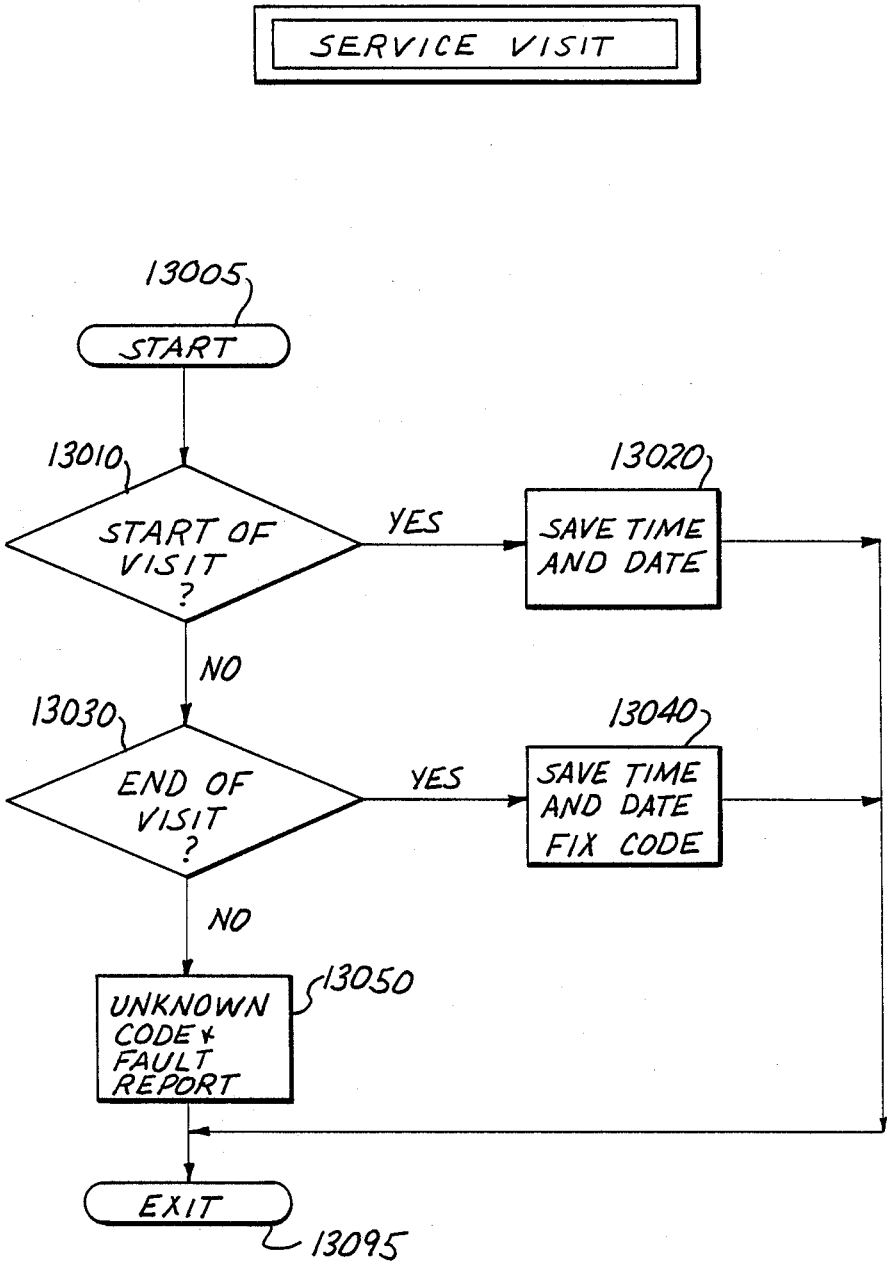

Considering now the SERVICE VISIT routine with respect to FIG. 19, it generally records the information via a telephone line from the device 12, when a service technician switches the device 12 from the normal operation mode to the service mode or vice versa. The SERVICE VISIT routine commences at 13005 with the software determining whether the device 12 is being placed in a service mode (start of visit), as indicated at 13010. If the device 12 is being placed in a service mode, then as indicated at 13020 the system will record the time and any service information in the data base, and the SERVICE VISIT routine is terminated at 13095.

If the monitor device 12 is not being placed in the service mode, then as indicated at 13030, the software determines whether the monitor has been placed in the normal operation (end of visit). If the monitor device 12 has been placed in the normal position, then as indicated at 13040, the system 10 will record the time and any information in the data base, and the SERVICE VISIT routine is terminated at 13095.

If the software determines that if the software determines that the monitor device 12 has not been placed in the normal operation, and does not recognize the monitor device transmission, then a fault report is generated at 13050, and the SERVICE VISIT routine is terminated at 13095.

In some instances, the operator at the remote station 26 needs to access the monitor device 12 for configuration purposes. In this regard, if new slaves are added to the monitor device 12, then such additional monitors need to be configured to the system. The configuration could be performed either remotely or on site.

The following optional features are available and programmable at the remote station 26:

1. Call a selected list of telephone numbers, to communicate with other remote stations.
2. Page a service personnel.

3. With the use of a voice synthesizer, make a verbal report.

4. Poll all available monitors constantly for status when not engaged in fault reporting.

5. Print all fault reports as they are transmitted from the monitor devices.

6. Record on memory elements such as floppy disks, the data needed for the analysis reports, with graphic and numeric tables.

7. Support over 100 monitor devices.

8. Support all functions of the escalator and/or elevator monitor system.

9. File and archive all faults by car and category.

10. Create a record on magnetic disks for statistics purposes, on repeat faults to be sorted by fault, car, date and time.

11. Print a weekly or monthly preventative maintenance task list for each elevator and/or escalator.

12. Receive data from the monitor describing the nature of the service tasks completed, and compiled for a monthly report.

13. Print a report indicating the actual time spent on each callback and each service visit.

14. Print a report showing the actual time spent on each trouble call in each category.

15. Automatic flagging of repeat trouble calls on a daily basis.

16. Prepare a report using all available data to determine the quality of maintenance and overall system performance, on a weekly through yearly basis.

17. All programmable monitor functions of the remote computing device to be menu driven.

18. All user functions of the monitor device to be programmable from the remote computing device and to be menu driven.

While the preferred embodiment describes the monitor device 12 as being connected to a group of elevator shaft controls, the device 12 could also be used to monitor escalator controls. In which event, the random access memory 65 will be reconfigured to reflect the different indications and fault conditions, such as the handrail and step speeds.

While a particular embodiment of the present invention has been disclosed, it is to be understood that various different modifications are possible and are contemplated within the true spirit and scope of the appended claims. There is no intention, therefore, of limitations to the exact abstract or disclosure herein presented.

What is claimed is:

1. A system for use with a plurality of segregated groups of controls, each group of controls having corresponding status control lines indicative of the operational status of an elevator, an escalator, or the like, the system comprising:

a series of monitor devices for monitoring the status control lines;

each one of said monitor devices corresponding to an individual one of the group of controls, for detecting operational problems associated therewith;

each one of said monitor devices having means for compiling said operational problems;

each of said monitor devices having means being responsive to the complied operational problems for diagnosing said problems to determine specific individual operational fault conditions associated with and corresponding to an individual one of the status control lines;

each of said monitor devices having means for generating fault message report information based on said operational problems, said report message identifying the diagnosed fault condition and the specific location of the operational problem.

2. A system according to claim 1, further including means for receiving the fault message report information generated by said monitor device;

a plurality of individual single communication links corresponding individually to one of said monitor devices, for facilitating connection selectively and individually one of said monitor devices to the means for receiving fault message reports;

wherein each one of said monitor devices includes one master module for diagnosing operational problems associated with the corresponding one of the group of controls;

a plurality of input and output ports; and a modem connected to one of said output ports, for connecting in communication said master module and said receiving means, over one of said individual single communication links.

3. A system according to claim 2, further including at least one slave module for diagnosing operational problems associated with the corresponding one of the groups of controls;

each one of said slave modules includes a plurality of input and output ports, for connecting in communication said slave modules and said master module.

4. A system according to claim 3, wherein said slave modules are connected sequentially in communication with one another, and with said master modules; and wherein the output port of only one of said slave modules is connected in communication with the input port of said master module.

5. A system according to claim 1, further comprising:

computing means including a computing device, and a computer software program adapted to control the operation of said computing device, for monitoring and diagnosing the status line said computing device including means for detecting a door switch failure, floor detecting means for detecting the identity of the floor of a building where the elevator car was located at the time of failure of said door switch, and means for determining that the failed door switch is located on the floor determined by the floor detecting means for purposes of identifying said specific location of the operational problem.

6. In a system according to claim 1, wherein each of said monitoring devices further includes autoranging circuit means for enabling said monitor devices to be connected to any alternating current or direct current type of segregated group of controls.

7. A method of using a monitor system in conjunction with a plurality of segregated groups of controls, each group of controls having corresponding status control lines indicative of the operational status of an elevator, an escalator, or the like, the method comprising:

monitoring the status control lines;

detecting operational problems on said monitored status control lines;

diagnosing said operational problems associated with each one of a series of monitor devices corresponding to an individual one of the groups of controls;

compiling said operational problem for diagnosing operational fault conditions;

diagnosing said compiled operational problems for fault conditions associated with and corresponding to an individual one of the status control lines;

generating fault message report information based on said diagnosed operational problems;

said fault message report identifying the diagnosed fault conditioning and the specific location of the operational problems.

8. In a monitoring system having a plurality of segregated groups of controls located in a corresponding plurality of remotely located buildings, each group of controls having corresponding status control lines indicative of the operational status of an elevator, an escalator or the like, the system comprising:

a plurality of monitoring means, each monitoring means being associated with a specific one of said group of controls and having monitor computing means for receiving and sending fault messages associated therewith;

at least one remotely located computing means for receiving and transmitting fault messages in response to messages received from said monitoring means;

said remotely located computing means including means responsive to said messages received from said monitoring means for sending a call-in message for a service technician;

said remotely located computing means having means for causing the transmission of a voice synthesizer message fault report including fault information for the service technician.

9. In a system according to claim 8, wherein said remotely located computing means includes means for determining whether the received fault message was generated by a service technician or alternately by one of said monitoring means; and program means responsive to said determining means for causing the execution of a call-in routine responsive to the receipt of a fault message not generated by a service technician for sending said call-in message to a service technician.

10. In a system according to claim 8, further including means for causing the transmission of a fault message to the monitor computing means indicative of a local fault condition.

11. A system for use with a plurality of segregate groups of controls, each group of controls having corresponding status control lines indicative of the operational status of an elevator; the system comprising:

a series of monitor devices for monitoring the status control lines and for generating fault message report information associated with said status control lines;

each one of said monitor devices corresponding to an individual one of the group of controls, for detecting and determining a time delay has occurred in the closure of a monitored door switch, said door switch being coupled to an individual one of said status control lines;

means for determining that said time delay has occurred beyond a predetermined period of time; and means responsive to said timing means for determining that said door switch is failing to cause a fault message report to be generated.

12. A system according to claim 11, wherein each one of said monitor devices further includes means for generating fault message report information based on the failure to generate a fault report message in response to determining that said door switch failure failed to cause a fault message report to be generated, said fault message report being indicative of a potential fault condition.

13. A system for use with a plurality of segregated groups of controls, each group of controls having corresponding status control lines indicative of the operational status of an elevator, an escalator or the like, the system comprising:

a series of monitor devices for responding to the status control lines;

each one of said monitor devices corresponding to an individual one of the group of controls for monitoring the operational problems associated therewith;

each one of said monitor devices corresponding to an individual one of the group of controls for detecting an operational problem associated therewith;

each one of said monitor devices including means for detecting that a detected operational problem has been corrected within a predetermined period of time;

means for determining the number of times said detected operational problem has corrected itself; and means for generating a fault message report in response to said determining means generating a signal indicative of a fault condition, said fault message report being indicative of an intermittent fault condition.

14. A system for use with a plurality of segregated groups of controls, each group of controls having corresponding status control lines indicative of the operational status of an elevator, an escalator or the like, the system comprising:

a series of monitor devices for responding to the status control lines;

each one of said monitor devices corresponding to an individual one of the group of controls for monitoring the operational problems associated therewith;

each one of said monitor devices corresponding to an individual one of the groups of controls includes first means for detecting a status control line condition indicative of an elevator car moving and a closed gate switch;

second means for detecting a status control line condition indicative of a door switch opening for a predetermined time only; and means for determining a clipped door lock condition has occurred in response to said first and second means.

15. A system according to claim 14, further including means for generating a fault report message in response to said clipped door lock condition, said fault message report being indicative of said clipped door fault condition.

16. A system for use with a plurality of segregated groups of controls, each group of controls having corresponding status control lines indicative of the operational status of an elevator, an escalator or the like, the system comprising:

a series of monitor devices for responding to the status control lines;

each one of said monitor devices corresponding to an individual one of the group of controls for monitoring the operational problems associated therewith;

each one of said monitor devices having one master module for diagnosing operational problems associated with the corresponding one of the group of controls;

each one of said monitor devices having at least one slave module for diagnosing operational problems associated with the corresponding one of the groups of controls;

each one of said slave modules includes a plurality of input and output ports for connecting sequentially in communication one slave module with another; and wherein one output port of an individual single slave module is connected sequentially in communication with one input port of said master module;

each one of said slave modules having means for communicating through its output port the diagnosed operational problems associated with one of the groups of controls of one of the slave modules connected sequentially on its input port;

each one of said master module having means responsive to a diagnosed operational problem received on its input port for determining a fault condition associated with and corresponding to a specific one of said status control lines; and each of said monitor devices having means for generating fault message report information based on said operational problems, said report message identifying the diagnosed fault condition and the specific location of the operational problem.

* * * * *

UNITED STATES PATENT AND TRADEMARK OFFICE

CERTIFICATE OF CORRECTION

PATENT NO. : 4,823,914

DATED : April 25, 1989

INVENTOR(S) : Robert C. McKinney, Lloyd F. Perry, Scott T. Boden

It is certified that error appears in the above-identified patent and that said Letters Patent is hereby corrected as shown below:

Column 8, Line 42 -- After "decoders", delete "160", and substitute therefor -- 150 --

Signed and Sealed this

Fifteenth Day of May, 1990

*Attest:*

HARRY F. MANBECK, JR.

*Attesting Officer*

*Commissioner of Patents and Trademarks*